US005735202A

United States Patent [19]

Sakakibara et al.

[11] Patent Number: 5,735,202

[45] Date of Patent: Apr. 7, 1998

[54] PRINT SORTING METHOD FOR IMAGE FORMING APPARATUS WITH SORTER AND CONTROL SYSTEM FOR EXECUTING SUCH PRINT SORTING METHOD

[75] Inventors: Toshiyuki Sakakibara; Mitsuo Sato, both of Shibata-machi, Japan

[73] Assignee: Tohoku Ricoh Co., Ltd., Miyagi, Japan

[21] Appl. No.: 784,991

[22] Filed: Jan. 17, 1997

[30] Foreign Application Priority Data

Apr. 4, 1996 [JP] Japan ..... 8-082797

[51] Int. Cl.[6] ..... B65H 39/00

[52] U.S. Cl. ..... 101/2; 270/58.14; 270/58.18; 271/288

[58] Field of Search ..... 400/624; 101/2; 270/58.14, 58.18; 271/298, 288

[56] References Cited

U.S. PATENT DOCUMENTS

| | | | |
|---|---|---|---|
| 4,157,822 | 6/1979 | Miller | 271/3.1 |
| 5,106,076 | 4/1992 | Fujita et al. | 271/288 |
| 5,155,538 | 10/1992 | Monfalcone | 271/288 |
| 5,625,860 | 4/1997 | Maeda et al. | 271/288 |

FOREIGN PATENT DOCUMENTS

| | | |
|---|---|---|
| 60-248566 | 12/1985 | Japan . |
| 4-105057 | 9/1992 | Japan . |
| 6-32039 | 2/1994 | Japan . |
| 6-340367 | 12/1994 | Japan . |
| 7-41238 | 2/1995 | Japan . |
| 7-309520 | 11/1995 | Japan . |

*Primary Examiner*—John S. Hilten
*Assistant Examiner*—Steven S. Kelley
*Attorney, Agent, or Firm*—Oblon, Spivak, McClelland, Maier & Neustadt, P.C.

[57] ABSTRACT

In an image forming apparatus with a sorter, prints which carry original images printed are delivered to bins of the sorter in two sorting steps. In a first sorting step, the prints are delivered to the bins in the grouped state. They are then collected and arranged in proper sequence in a second step using the image forming apparatus. Prior to the second step, the prints are relocated to a sheet tray from the bins. Thereafter, the prints are conveyed by the printing operation of the image forming apparatus, and are delivered to the bins of the sorter. At the end of the second step, the prints on the bins are collected and arranged in proper sequence in accordance with an original document.

15 Claims, 15 Drawing Sheets

PRINT SORTING METHOD FOR IMAGE FORMING APPARATUS WITH SORTER AND CONTROL SYSTEM FOR EXECUTING SUCH PRINT SORTING METHOD

FIELD OF THE INVENTION

This invention relates to a method of sorting printed sheets for an image forming apparatus with a sorter, and more particularly to a control system for enabling such an image forming apparatus to execute the foregoing sorting method.

DESCRIPTION OF PRIOR ART

Copying machines and printing machines having directly coupled sorters are well-known. Such sorters are known as on-line sorters. The on-line sorter collects and arranges in proper sequence copied or printed sheets which are distributed to a plurality of receptacles called bins during a copying or printing operation.

Co-pending Japanese Patent Laid-Open Publication No. 7-309520 discloses a stencil printer with an on-line sorter. The stencil printer 1 comprises the on-line sorter 2, a printer control unit 3, and a sorter control unit 4. It is assumed here that the on-line sorter 2 includes twenty bins, and that 30 sets of prints are produced from 10-leaf originals (i.e. first to tenth originals). For this purpose, an operator sets the 10-page originals on an automatic document feeder (called the "ADF" hereinafter), presses a mode selection key once so as to select a "SORT MODE", enters, using numeric keys "30", as the number of sets of prints to be produced, and presses a print start key.

First of all, the ADF conveys the tenth original to a scanner of the printer 1. An image on the tenth original is read by the scanner, which produces image data. A stencil is perforated in accordance with the image data, and is wrapped round a print drum. A sheet is conveyed to the print drum, and is pressed against the print drum via the perforated stencil by a press roller. Thus, the original image is printed on the sheet. The printed sheet is carried to the on-line sorter 2 coupled to the stencil printer 1, and is delivered to a first bin. A second printed sheet and succeeding printed sheets are respectively delivered to the remaining bins. All twenty of the bins accommodate the printed sheets which are collected and arranged in proper order. The remaining ten printed sheets are received and stacked on a non-sort tray which is independent of the foregoing bins.

When the 30 printed sheets are produced from the tenth original, the ADF carries the ninth original to the scanner, which reads the original. This original is also printed on sheets similarly to the tenth original. The printed sheets carrying the image of the ninth original are respectively distributed to the first to twentieth bins. The remaining ten printed sheets are stacked on the non-sort tray similarly to those of the tenth original. Images of the eighth, seventh, . . . , and first originals are similarly printed on sheets, so that printed sheets are delivered to the twenty bins such that they are collected and arranged in proper sequence. The printed sheets which are not received in the twenty bins are stacked on the non-sort tray. In other words, each bin accommodates the printed sheets which contain the first to tenth pages, and are collected and arranged in the proper sequence.

Alternatively, it is conceivable to perform printing repeatedly using different stencils. It is also assumed that 30 sets of printed sheets are to be produced from ten-page originals. The operator sets the ten originals on the ADF, presses the mode selection key once, enters the number of printed sheets "20" using numeric keys, and presses the print start key, thereby activating the stencil printer. At the end of the printing operation, twenty sets each containing 10 printed sheets are automatically collected and arranged in proper sequence on the twenty bins. Thereafter, the operator takes all the printed sheets out of the bins, again sets the ten-page originals on the ADF, and enters the number of printed sheets "10", thereby activating the stencil printer. Ten sets, each containing 10 printed sheets, are collected and arranged in the proper sequence in ten bins of the on-line sorter 2. In this manner, it is possible produce 30 sets of printed sheets from the ten-page originals.

Usually, one on-line sorter includes approximately 20 bins. Sometimes, a plurality of on-line sorters are simultaneously used in order to increase the number of bins. Japanese Patent Laid-Open Publication No. 60-248566 and the foregoing publication disclose such sorters.

In the foregoing first method, ten sets each of printed sheets of the same pages are simply stacked on the non-sort tray. This means that these printed have to be manually collected and arranged in the proper sequence after the printing operation is completed.

This manual collection and arrangement job is troublesome and time-consuming, and may be carried out incorrectly. Further, there is a problem that a large table or the like should be used for this job. There will be no problem if the on-line sorter includes thirty bins. However, the more bins, the larger and more expensive the on-line sorter. Further, a larger space should be prepared for such an on-line sorter. Thus, it is substantially impossible to automatically collect and arrange printed sheets in proper sequence when the number of sets of printed sheets exceeds the quantity of bins.

The foregoing second method is free from the troublesome and time-consuming manual collection and arrangement of the printed sheets in the proper sequence. However, each page of the originals should be printed twice, so that an amount of used stencils will be doubled. With the stencil printer, the cost of the stencil contributes a relatively large part of the printing cost. Thus, it is disadvantageous that the stencil printer requires a large running cost. The foregoing example is given in order to simplify the description. For example, if 50 sets of printed sheets are produced from ten-page originals using a stencil printer with a 20-bin sorter, the amount of stencils will be tripled.

If a plurality of on-line sorters are used concurrently, they are too expensive and require a large installation space.

SUMMARY OF THE INVENTION

In order to overcome the foregoing problems of the prior art, the invention is aimed at providing a method of sorting printed sheets and a control system for executing this method using a small and inexpensive sorter with a reduced number of bins, even when a large number of sets of printed sheets should be produced. This sorting method and the control system enable automatic collection and arrangement of printed sheets in proper sequence without wasting stencils.

According to the invention, prints which carry original images printed by an image forming apparatus are delivered to bins of a sorter in two sorting steps. In a first sorting step, the prints are delivered to the bins in the grouped state. They are then collected and arranged in proper sequence in a second step using the image forming apparatus. Prior to the second step, the prints are relocated to a sheet tray from the bins. Thereafter, the prints are conveyed by the printing operation of the image forming apparatus, and are delivered to the bins of the sorter. At the end of the second step, the prints in the bins are collected and arranged in proper sequence in accordance with an original document.

When the number N of prints to be produced from an original document having a plurality of leaves is equal to or less than the total number M of bins of the sorter (i.e. N≦M), a sort mode is executed in order to deliver prints of the original document to N bins where they are collected and arranged in proper sequence in accordance with the original document. Conversely when N is more than M (N>M), the first and second sorting steps are sequentially executed in order to deliver the prints to the bins where they are collected and arranged in proper sequence.

In the first sorting step, the images of the original document are printed on sheets by the image forming apparatus. In the second sorting step, no image is printed by the image forming apparatus. Specifically, when the image forming apparatus is a stencil printer, a stencil perforated based on original images is used to print sheets in the first sorting step. In the second sorting step, a non-perforated stencil is wrapped round a print drum and the printing operation is performed simply in order to feed the prints from the sheet tray to the sorter (i.e. no printing is actually performed).

In the case of an integrated stencil printer, a non-perforated stencil is prepared by preventing the operation of a thermal head as a stencil perforating member using a control unit comprising a microcomputer and/or a control circuit, or by using a blank original document.

BRIEF DESCRIPTION OF THE DRAWING FIGURES

In all Figures, identical parts have identical reference numerals.

DESCRIPTION OF THE PREFERRED EMBODIMENTS

Figure 1:
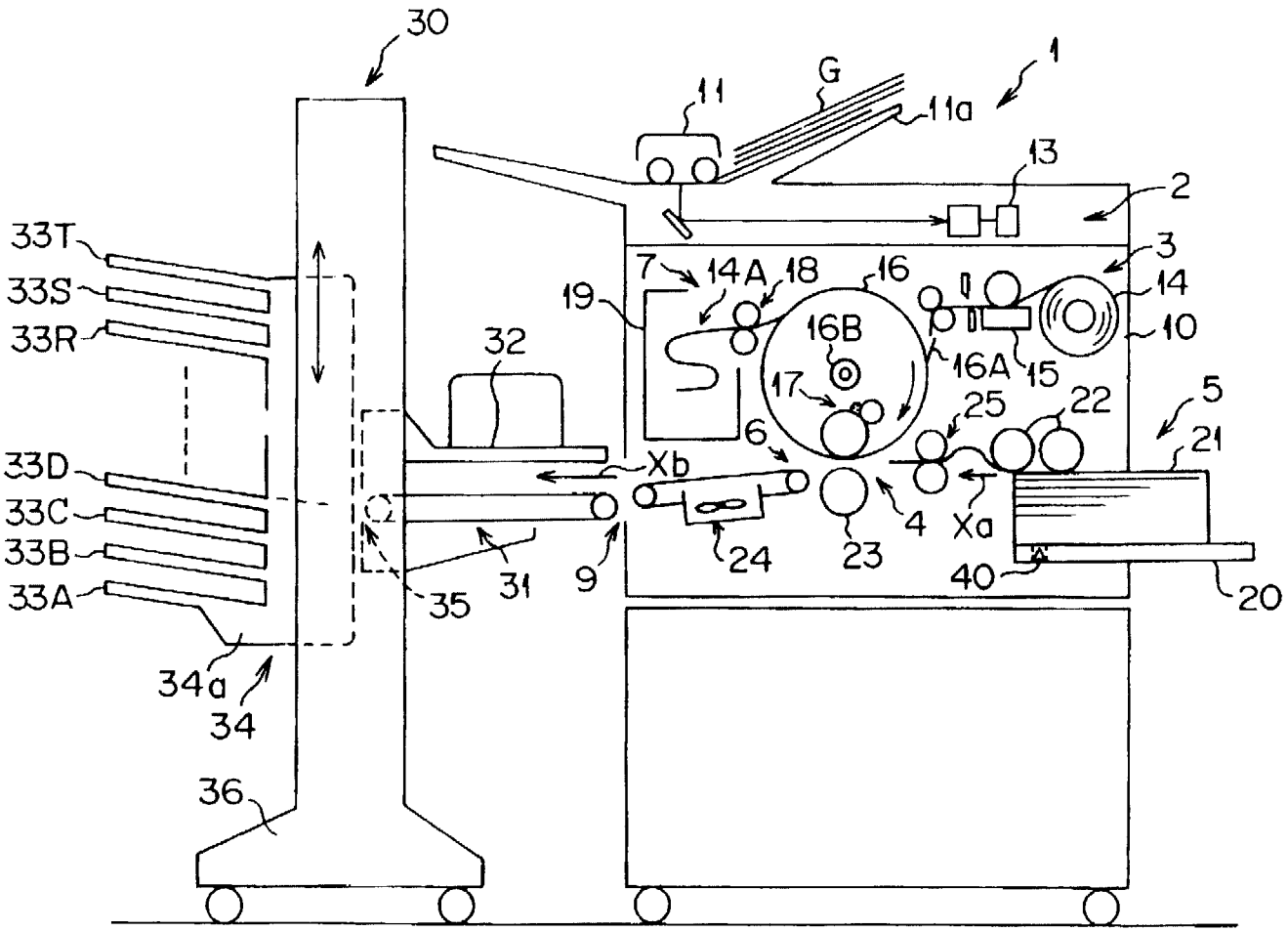
FIG. 1 shows the overall configuration of a stencil printer including an on-line sorter to which a first embodiment of the invention is applied.

In order to simplify the description, some well-known components are referred to and shown without reference numerals. Further, some paired components are usually described with respect to only one of them.

(Embodiment 1)

The invention will be described with reference to a first embodiment shown in FIGS. 1 to 3. Referring to FIG. 1, an integrated type stencil printer 1 is used in combination with an on-line sorter 30, and performs both stencil perforation and printing using thermosensitive stencils.

The stencil printer 1 prints an image of an original G on sheets 21. The on-line sorter 30 distributes printed sheets 21 to a plurality of bins 33 (labeled 33A to 33T in FIG. 1) of a bin unit 34 which is moved up and down. The on-line sorter 30 includes an intermediate delivery unit 31 on a side facing toward the bins 33A to 33T. The intermediate delivery unit 31 delivers, to the bins 33A–33T, the printed sheets 21 arriving via a print discharging outlet 9. The on-line sorter 30 is connected to the stencil printer 1 via the intermediate delivery unit 31 whose one end is coupled to the print discharging outlet 9. The stencil printer 1 and the on-line sorter 30 are electrically connected by a communication line (not shown).

Functions and arrangement of the stencil printer 1 and the on-line sorter 30 are substantially identical to those disclosed in co-pending Japanese Patent Laid-Open Publication No. 7-309520. The stencil printer 1 and the on-line sorter 30 will be particularly described with respect to their structures and functions which are essential to the invention.

The stencil printer 1 can be opened at its top part, and comprises an automatic document feeder 11 (called the "ADF 11" hereinafter), a document reader 2, a stencil perforating unit 3, a printing unit 4, a sheet feeding unit 5, a print discharging unit 6, and a used stencil take-up unit 7.

The ADF 11 sequentially feeds originals G to the document reader 2. The document reader 2 reads images on the originals G, retrieves them, and includes a scanner and so on. The stencil perforating unit 3 perforates a stencil 14 in accordance with image data from the document reader 2. The stencil 14 is in the shape of a roll, and is positioned below the document reader 2 in a printer body 10. The printing unit 4 is disposed substantially at the center of the stencil printer 1, and includes a print drum 16 around which a perforated stencil 14 is wound. The sheet feeding unit 5 is positioned below the stencil perforating unit 3, and feeds sheets 21 from a sheet tray 20 to an area under the printing unit 4. The printed sheet discharging unit 6 is disposed at the lower part of the stencil printer 1 or at a position opposite to the sheet feeding unit 5, and carries printed sheets 21 to the intermediate delivery unit 31. The used stencil take-up unit 7 is positioned between the print discharging unit 6 and the document reader 2, peels a used stencil 14A off from the print drum 16, and discharges it into a used stencil box 19.

The ADF 11 comprises an original support 11*a* for supporting the originals G, and feed rollers, motors for feeding, conveying and retrieving the originals G and so on which are well-known in an automatic sheet feeder. The document reader 2 is identical to that disclosed in Japanese Patent Laid-Open Publication No. 5-229243. In FIG. 3, both the ADF 11 and the document reader 2 are shown as "ADF/document reader unit 113".

The stencil perforating unit 3 comprises a stencil roll holder, a thermal head 15, a platen roller, a cutter, and a stencil conveying member. The stencil roll holder accommodates the stencil 14 in the shape of a roll. The thermal head 15 selectively and thermally perforates the stencil 14 on the basis of image data. The platen roller confronts the thermal head 15, pushes the stencil 14 toward the thermal head 15, and conveys it downstream in a stencil transport direction. The cutter cuts the stencil to a predetermined length. The stencil conveying member includes a pair of feed rollers for feeding the perforated stencil toward a clamp 16A on the outer surface of the print drum 16, and is positioned between the cutter and the print drum 16. A stencil perforating/feeding mechanism 114 in FIG. 3 denotes the foregoing components whose operations are controlled by a control system of the invention.

The printing unit 4 comprises the print drum 16, the clamp 16A, and an ink supply 17. The print drum 16 is a porous cylinder, is activated by a rotational force transmitting member such as gears (not shown), and is rotatable on a center shaft 16B. The clamp 16A is attached to the outer surface of the print drum 16, is freely opened and closed thereon, and grips a leading edge of the stencil 14. The ink supply 17 is positioned inside the print drum 16 so as to supply ink to the inner surface of the print drum 16. The ink supply 17 is identical to that disclosed in Japanese Patent Laid-Open Publication No. 5-229243.

With the printing unit 4, the printer body 10 includes a stationary member (not shown) for supporting a frame (not shown) on which the print drum 16 is rotatably disposed. Both the stationary member and the frame are identical to those described in Japanese Patent Laid-Open Publication No. 5-229243. Therefore, the print drum 16 is detachable from the printer body 10.

A press roller 23 is positioned under the print drum 16. The press roller 23 is movable to and from the print drum 16, and presses a sheet 21, from the sheet feeding unit 5, against the outer surface of the print drum 16.

Figure 3:
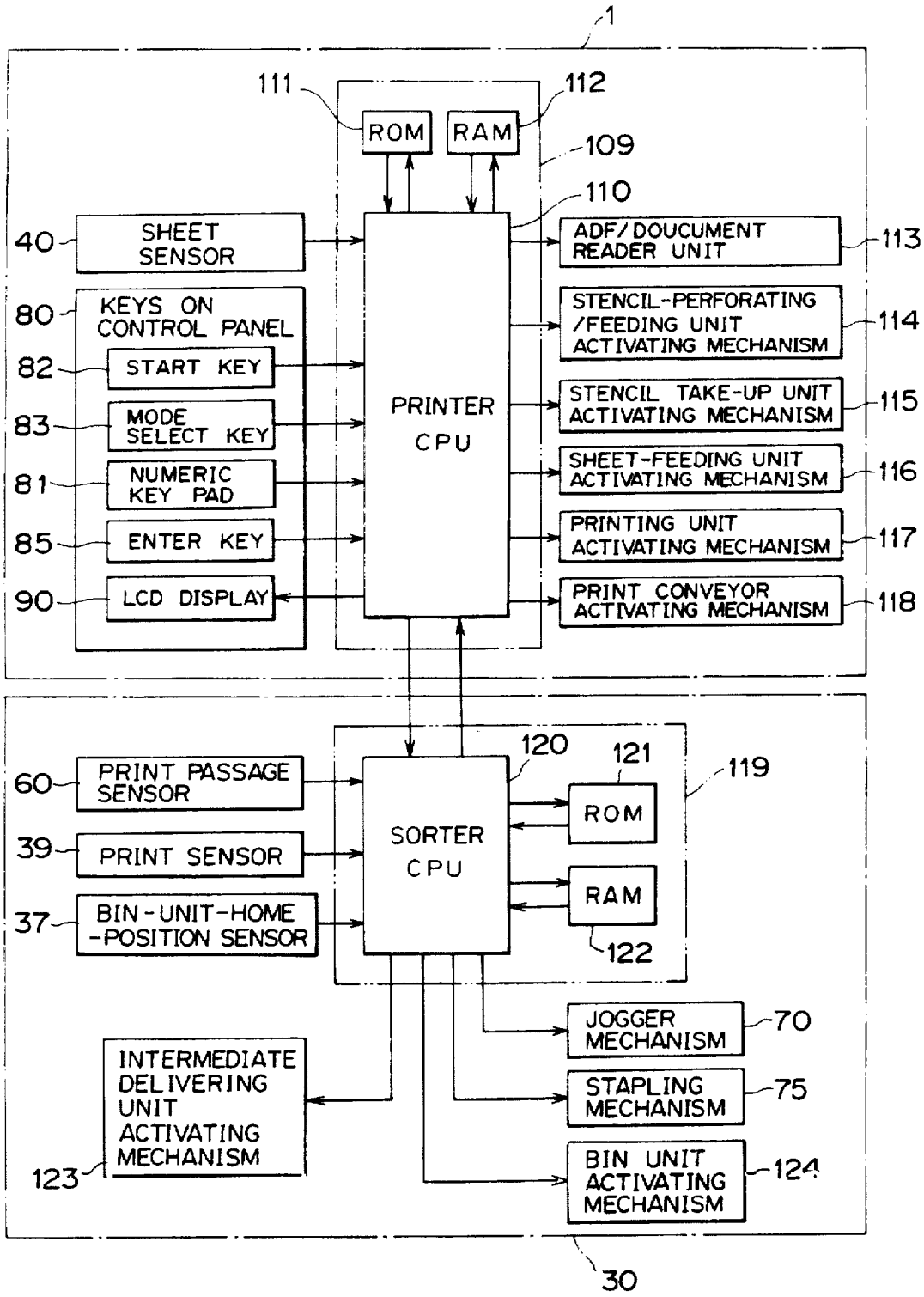
FIG. 3 is a block diagram of a control system comprising a printer control unit and a sorter control unit used in the stencil printer.

Referring to FIG. 3, a "printing unit activating mechanism 117" denotes a member for activating the print drum 16, a member (not shown) for operating the clamp 16A, a member (not shown) for activating the ink supply 17 and so forth. The operations of these members are controlled by the control system of the invention.

The sheet feeding unit 5 includes the sheet tray 20 accommodating sheets 21 thereon, a pair of feed rollers 22, and a pair of register rollers 25. The feed rollers 22 are in contact with each top sheet 21, and separate and feed the sheets 21 one by one from the sheet tray 20. The register rollers 25 periodically feed the sheets 21 into a space between the outer surface of the print drum 16 and the press roller 23. The sheet tray 20 is vertically movable by a lift mechanism (not shown) which is supported by right and left side plates (not shown) of the printer body 10. The sheet tray 20 is a two-piece member, i.e. front and rear halves (not shown). The rear half of the sheet tray 20 is supported by a pivot (not shown) so as to be upright. The front half of the sheet tray 20 has a pair of right and left side barriers (not shown), which are slidable so as to position the sheets 21 laterally.

A member (not shown) for activating the sheet tray 20, the feed rollers 22 and register rollers 25 whose operations are controlled by the control system are denoted by a "sheet-feeding unit activating mechanism 116" in FIG. 3.

The sheet tray 20 includes, on its front half, a sheet sensor 40 for detecting the presence or absence of sheets 21 thereon. The sheet sensor 40 is a well-known reflection type photosensor having light emitting elements and photosensitive elements, and is turned on in response to light reflected from the sheets 21.

The print discharging unit 6 includes a print separating member (not shown), and a print conveyor 24. The print separating member peels each printed sheet 21 off from the print drum 16. The print conveyor 24 includes a pair of feed rollers, an endless belt extending round the feed rollers, and a suction fan, and conveys the printed and separated sheet 21 to the intermediate delivery unit 31.

The print conveyor 24 and so on, whose operations are controlled by the control system, are shown as a "print conveyor activating mechanism 118" in FIG. 3.

The stencil take-up unit 7 includes a stencil peeler 18 and the used stencil box 19. The stencil peeler 18 has a pair of rollers which are in pressure contact with each other, and rotate in synchronization with the print drum 16, and peels a trailing edge of a used stencil 14A off from the print drum 16. The used stencil box 19 houses used stencils.

In the stencil take-up unit 7, the parts and the stencil peeler 18 whose operations are controlled by the control system are denoted by a "stencil take-up unit activating mechanism 115" in FIG. 3.

Figure 2:
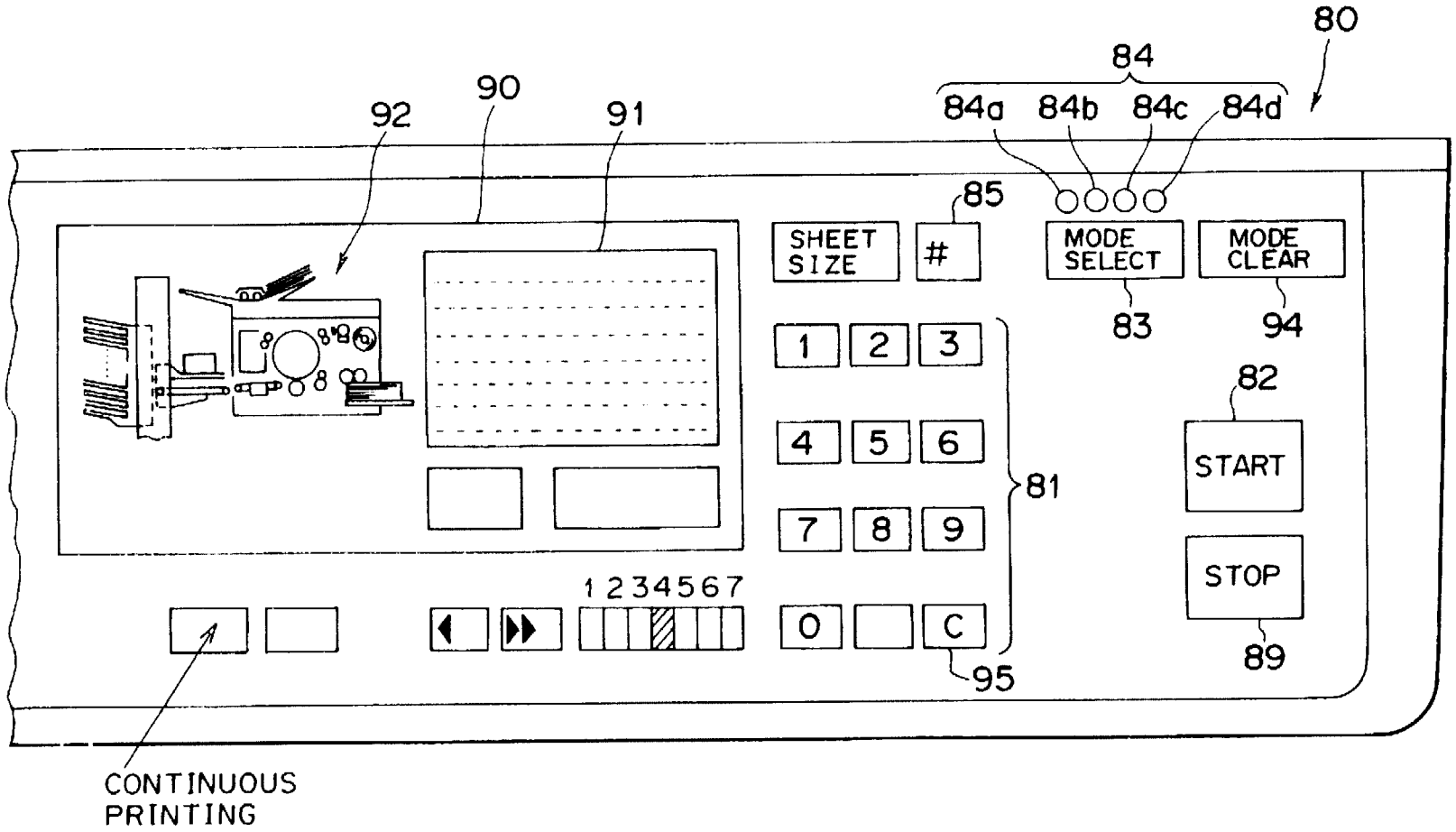
FIG. 2 is a plan view of a control panel of the stencil printer.

Referring to FIG. 2, the stencil printer 1 has a control panel 80 above the document reader 2. The control panel 80 is used to operate the stencil printer 1 and the on-line sorter 30, and includes numeric keys 81, a START key 82, a MODE SELECT key 83, a group of LED (light emitting diode) lamps 84, a STOP key 89, a liquid crystal display 90, a MODE CLEAR key 94, and a CLEAR key 95.

The numeric keys 81 are selectively pressed so as to enter the number of prints to be produced per original G and the number of originals G. An ENTER key 85 is pressed to complete data inputted by the numeric keys 81. The START key 82 activates the stencil printer 1 so as to execute operations from reading of the original G, feeding of a stencil, trial printing, and final printing.

The MODE SELECT key 83 selectively establishes an operation mode (to be described later). The LED lamps 84 (i.e. lamps 84*a* to 84*d*) indicate the operation modes specified by the MODE SELECT key 83. The STOP key 89 is operated so as to cancel the foregoing operations. The liquid crystal display 90 offers instructions for an operator to effect first and second sorting steps. The MODE CLEAR key 94 cancels the operation mode specified by the MODE SELECT key 83. The CLEAR key 95 cancels the data specified by the numeric keys 81.

When operated, numeric keys 81 generate a signal indicative of the number of prints to be produced.

The LED lamps 44*a* to 44*d* are juxtaposed at the upper part of the control panel 80 as shown in FIG. 2. When the MODE SELECT key 83 is pressed once, the LED lamp 84*a* is lit so as to indicate a "sort mode". In the sort mode, printed sheets are distributed to respective bins 33, where they are collected and arranged in proper sequence in accordance with images of the originals G having a plurality of leaves. When the MODE SELECT key 83 is pressed twice, the LED lamp 84*b* is lit so as to indicate a "sort-and-staple mode". In this mode, the printed sheets are collected and arranged in proper sequence in the foregoing sort mode, and are automatically stapled. Three depressions of the MODE SELECT key 83 turn on the LED lamp 84*c* so as to indicate a "continuous mode". In the continuous mode, printed sheets produced from one original G are distributed one by one to the respective bins 33. Finally, when the MODE SELECT key 83 is pressed four times, the LED lamp 84*d* is turned on so as to indicate a "group mode". In the group mode, printed sheets are distributed to the bins in a grouped state by an operation similar to that of the continuous mode.

The sort mode, sort-and-staple mode, continuous mode, or group mode is established depending upon the number of depressions of the MODE SELECT key 83 as described above. Each time it is pressed, the MODE SELECT key 83 turns on the LED lamp 84*a*, 84*b*, 84*c* or 84*d* in succession, and issues a signal indicative of the selected mode. The MODE SELECT key 83 is positioned near the LED lamps 84, thereby enabling the operator to know the selected mode by viewing the LED lamps 84.

When the MODE SELECT key 83 is not pressed in order to operate the stencil printer 1, a non-sort mode is automatically established.

The liquid crystal display 90 includes a guidance screen 91 and a sub-guidance screen 92. The guidance screen 91 gives literal instructions for the operator to proceed with the first and second sorting steps. The sub-guidance screen 92 not only schematically shows the contents of the foregoing instructions but also shows a faulty portion in the stencil printer 1 when it suffers from a jammed stencil or sheet, and so on. The liquid crystal display 90 is electrically connected to a printer control unit 109 (to be described later) via an LCD driver circuit or the like.

The on-line sorter 30 comprises the intermediate delivery unit 31, the bin unit 34, and a lift (not shown) for vertically moving the bin unit 34. The intermediate delivery unit 31 delivers to the bins 33 printed sheets 21 which are received via the print discharging outlet 9. The bin unit 34 includes the bins 33 which are aligned one after another, and receive the printed sheets 21 distributed in accordance with the selected mode. The bin unit 34 is vertically moved by the lift. Both the intermediate delivery unit 31 and the lift are identical to those shown in FIG. 2 of Japanese Patent Laid-Open Publication No. 7-309520, and will not be described in detail. The intermediate delivery unit 31 also includes a non-sort tray 32, and a lift (not shown) for moving vertically. The non-sort tray 32 and the lift are identical to those shown in FIG. 6 of co-pending Japanese Patent Laid-Open Publication No. 7-41238, and will not be described in detail.

A motor and so on for the intermediate delivery unit 31 whose operations are controlled by the control system are depicted as an "intermediate delivery unit activating mechanism 123" in FIG. 3.

Figure 4:
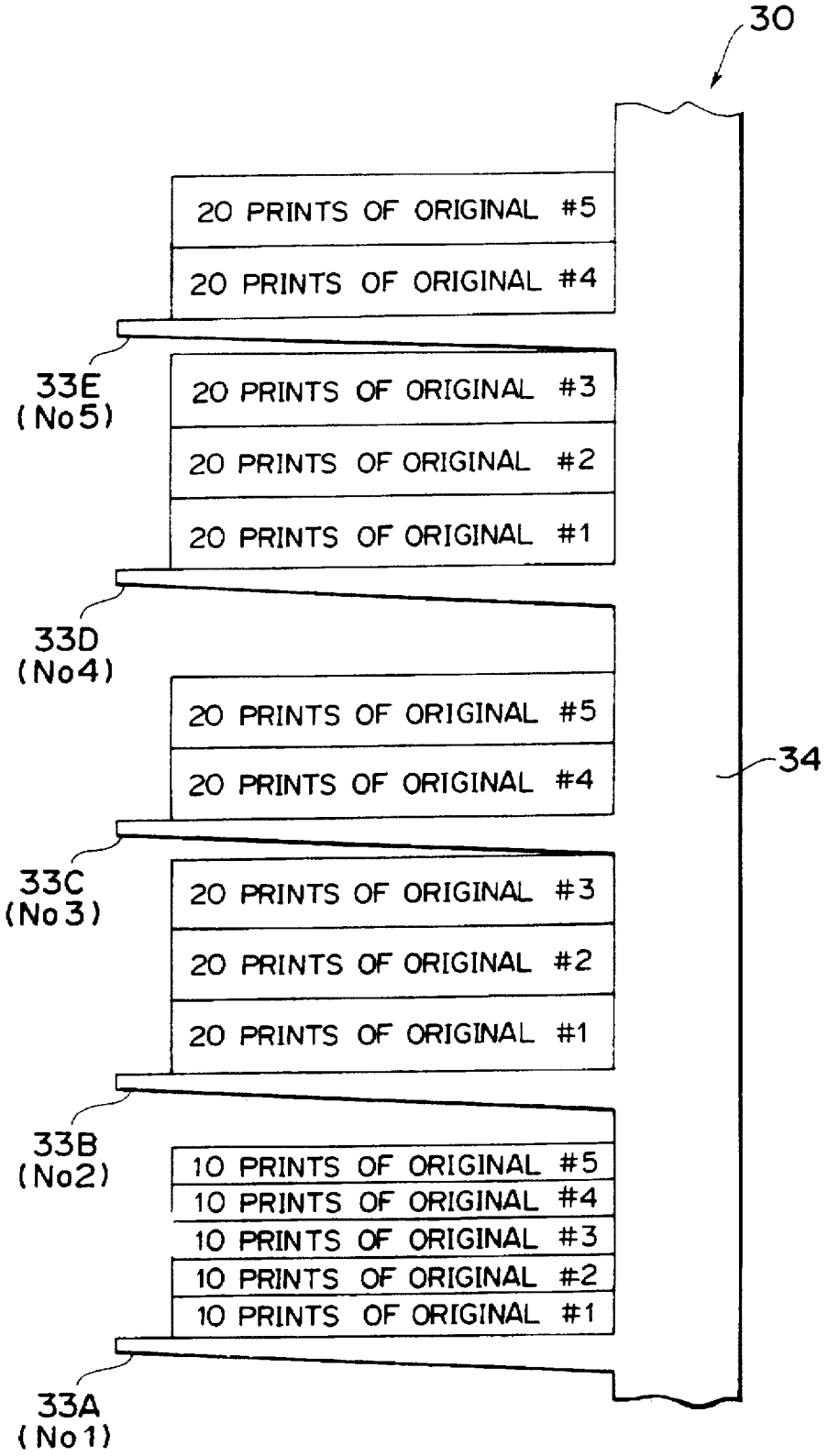
FIG. 4 shows a state of printed sheets which are grouped by the on-line sorter during a first sorting step.

The bin unit 34 is schematically depicted in FIG. 1, and is actually structured as shown in FIGS. 2 to 4 of Japanese Patent Laid-Open Publication No. 7-309520. Specifically, the bin unit 34 includes a plurality of identical bins 33, a pair of guide rails, and a housing 34*a*. The bins 33 are aligned with predetermined spaces kept therebetween. The guide rails guide the front edges of the bins 33 via which printed sheets are delivered. The housing 34*a* rotatably supports the bins 33 at the rear edges thereof, and is movable with the bins 33 by the foregoing lift for the bin unit 34.

In the first embodiment, the bin unit 34 has twenty bins 33, which are assigned alpha-numerals 33A to 33T from bottom to top. For example, the bin 33A is the lowermost bin, and is called "No. 1 bin 33A"; the bin 33B is second from the lowermost bin, and is called "No. 2 bin 33B", . . . , the bin 33T is the topmost bin, and is called "No. 20 bin 33T".

In the bin unit 34, each bin 33 can accommodate 60 printed sheets at maximum.

The non-sort tray 32 has a large capacity, and is used to receive printed sheets when the stencil printer 1 is operated without any sorting operation. In such a case, the intermediate delivery unit 31 is lowered by the lift (not shown) such that the non-sort tray 32 is moved so as to be in alignment with the print discharging outlet 9 of the stencil printer 1.

Print sensors 39 (shown only in FIG. 3) are disposed near the front edges of the bins 33. The print sensors 39 are reflection type photosensors having light emitting elements and photosensitive elements. Each print sensor 39 is turned on when it detects light reflected from the rear surface or margins of the printed sheet 21.

The bin unit 34 is vertically moved by the lift of a well-known lead cam type, which is connected to a motor (not shown) housed in a stand 36 of the on-line sorter 30. The bin unit 34 is moved up and down by the lift driven by the foregoing motor. The lead cam is positioned so as to confront a print inlet 35 (shown in FIG. 1) for passing the printed sheets 21.

The motor for the foregoing lift and so on, whose operations are controlled by the control system, are shown as a "bin unit activating mechanism 124" in FIG. 3.

As shown only in FIG. 3, the on-line sorter 30 also includes a jogger 70 and a stapling unit 75. The jogger 70 straightens the printed sheets on the respective bins 33. The stapling unit 75 staples the printed sheets which are collected and arranged in proper sequence and jogged. The jogger 70 and the stapling unit 75 are well-known, e.g. they are identical to those disclosed in Japanese Patent Laid-Open Publication No. 2-56367. When the sort-and-staple mode is selected, the stapling unit 75 staples the printed sheets 21.

A print passage sensor 60 (shown only in FIG. 3) is disposed above the print inlet 35, and detects each printed sheet passing through the printed sheet inlet 35. The print passage sensor 60 is a reflection type sensor having light emitting and photosensitive elements, and is electrically connected to a sorter control unit 119. Each time it detects a passing printed sheet 21, this sensor 60 provides a signal to the sorter control unit 119. In response to this signal, the sorter control unit 119 activates the motor for the bin unit activating mechanism 124 such that the lead cam rotates once. Thus, the bins 33 are lifted (or lowered) by one step.

In the on-line sorter 30, the stand 36 houses a bin-unit-home-position sensor 37 (shown only in FIG. 3) at its predetermined position. This sensor 37 detects whether or not No. 20 bin 33T (i.e. the top bin) confronts the print inlet 35. The housing 34*a* of the bin unit 34 has a projecting plate (not shown) on the bottom thereof. The sensor 37 issues an ON signal when it detects the projecting plate. Otherwise, the sensor 37 issues an OFF signal. The sensor 37 may be a photo-interrupter type sensor, a light reflecting type sensor, a microswitch, or the like.

In the stencil printer 1 the on-line sorter 30, the ADF/document reader unit 113, stencil-perforating/feeding unit activating mechanism 114, stencil take-up unit activating mechanism 115, sheet feeding unit activating mechanism 116, printing unit activating mechanism 117, print conveyor activating mechanism 118, intermediate delivery unit activating mechanism 123, bin unit activating mechanism 124, jogger 70, and stapling unit 75 are referred to as "the activating mechanisms and units" in FIG. 3.

Control of the stencil printer 1 and the on-line sorter 30 will be described with reference to FIG. 3. The printer control unit 109 and the sorter control unit 119 constitute the control system of the invention, are electrically connected, and transfer various command signals, ON and OFF signals, and data signals therebetween. The printer control unit 109 is a microcomputer in which a printer CPU (central processing unit) 110, an I/O (input/output) interface (not shown), a ROM (read only memory) 111, a RAM (random access memory) 112, and so on are connected via signal buses (not shown). The sorter control unit 119 is a microcomputer in which a sorter CPU 120, an I/O port (not shown), a ROM 121, a RAM 122 and so on are connected via signal buses (not shown). Both the printer control unit 109 and the sorter control unit 119 are mounted on boards (not shown) of the printer body 10 in the stencil printer 1.

The printer control unit 109 performs the following functions. A first function of the printer control unit 109 is as follows. In response to the sort mode signal issued by one depression of the MODE SELECT key 83, and the signal indicative of the number of printed sheets to be produced (which is entered by pressing numeric keys 81 and the ENTER key 85), the printer control unit 109 controls the operations of the activating mechanism and units in FIG. 3 so as to execute the sort mode, when the number N of printed sheets (called "prints" hereinafter) to be produced per original G is equal to or smaller than the number M of bins 33 (i.e. $N \leqq M$).

Conversely, if the number N of prints per original G is above the number M of bins (i.e. $N>M$), the printer control unit 109 controls the activating mechanisms and units in FIG. 3 so as to group the prints in the first sorting step.

In the first sorting step, the prints 21 are distributed to the respective bins 33 in the grouped state. The prints 21 are removed from the bins 33, are relocated to the empty sheet tray 20, and are delivered to the bins 33 by the second sorting step using the sort mode. The first and second sorting steps will be detailed later.

The printer control unit 109 has the following second function. It is assumed here that N prints are to be produced per original G, M bins 33 are used so as to receive the N prints, and a natural number $\alpha$ (having a predetermined range of values) can be set in the printer control unit 109 as the additional number of prints per original G. If $N \geqq (M+\alpha)$, the printer control unit 109 controls the activating mechanisms and units in FIG. 3 such that the prints undergo the first and second sorting steps.

If $N<(M+\alpha)$, the printer control unit 109 controls the activating mechanisms and units in FIG. 3 such that the "M" prints 21 are delivered to the bins 33 in the sort mode and that "$\alpha$" prints 21 are delivered to the non-sort tray 32.

The natural number $\alpha$ is determined such that it is rather convenient for the operator to manually sort the prints 21 on the non-sort tray 32, considering a time period consumed for the on-line sorter 30 to perform the sorting steps. The natural number $\alpha$ is stored in the ROM 111 of the printer control unit 109 beforehand. Alternatively, the printer control unit 109 may be programmed such that the operator can set the natural number "$\alpha$" using the numeric keys 81, ENTER key 85 and another key whenever necessary. Further, the natural number $\alpha$ may be stored in a PROM, in place of the ROM 111, so as to be updated appropriately. In other words, the natural number $\alpha$ is set and stored in the printer control unit 109.

From the foregoing, it is usually preferable that the natural number $\alpha$ is 1 to 4. In the first to third embodiments of the invention, the natural number $\alpha(\leqq 4)$ is stored in the ROM 111 of the printer control unit 109.

The printer control unit 109 performs a third function under the following conditions: the original G has L leaves; N prints are to be produced per leaf of the original G; M bins 33 are available; and each bin 30 has a maximum capacity P (=P prints). It is assumed that $(N>M)$, and $((L \times M) \leqq P)$. In the first sorting step, each $(L \times M)$ prints 21 are grouped and distributed to (N/M) bins 33 respectively (with the decimals rounded up). In the second sorting step, the sort mode is executed (N/M) times such that each bin 33 accommodates L prints 21. The decimals of (N/M) are also rounded up in this case.

The following describes how data of the L-leaf original G are set and inputted. In this embodiment and in the second embodiment (to be described later), the following conditions are assumed. When L is equal to or less than M (i.e. $L \leqq M$) and when L is not set and entered by pressing numeric keys 81 and ENTER key 85, the printer control unit 109 determines that L is at least equal to or less than M, and selects programs for the first and second sorting steps. The printer control unit 109 then computes conditions for grouping and distributing prints 21. If L is above M (i.e. $L>M$) as in the third embodiment, L may be set in the printer control unit 109 by pressing numeric keys 81 and the ENTER key 85. Alternatively; the ADF 11 may be replaced by a recycle type ADF which is extensively used for an electrophotographic copying machine or the like. Such an ADF counts the number L of leaves of the original G and provides a count to the printer control unit 109.

According to a fourth function, the printer control unit 109 controls the activating mechanisms and units in FIG. 3 as follows. Specifically, in the first sorting step, N prints per original G are grouped and distributed to the respective bins 33. In this state, each bin 33 accommodates M prints. In the second sorting step, the sort mode is repeated L times such that M prints be distributed one by one to the respective bins 33. In this case, each time the sort mode is repeated, the stencil printer 1 and the on-line sorter 30 are temporarily made inactive. Then, the operator removes the grouped prints 21 from the bins 33, and relocates them to the sheet tray 20.

With a fifth function, in the first sorting step, the printer control unit 109 controls the activating mechanisms and units in FIG. 3 such that the stencil printer 1 prints sheets 21 in the usual manner, and that in the second sorting step, the stencil printer 1 then performs the printing operation using a non-perforated stencil 14 wound around the print drum 16.

The printer control unit 109 has a sixth function as described hereinafter. In response to the signal from the sheet sensor 40 and the print sensors 39, the printer control unit 109 checks whether or not the operator correctly follows the instructions on the guide screen 91 and/or sub-guide screen 92 of the liquid crystal display 90. Only when the instructions are correctly observed, does the printer control unit 109 enable the stencil printer 1 and the on-line sorter 30 to proceed with the next step.

Alternatively, the sorter control unit 119 may share some of the foregoing functions of the printer control unit 109. According to the invention, the printer control unit 109 and/or the sorter control unit mainly function(s) as the control system of the image forming apparatus. In a rare case, the sorter control unit 119 may perform all the control functions of the printer control unit 109.

The printer control unit 109 is electrically connected to driving circuits (not shown) of the keys on the control panel 80 and the liquid crystal display 90, and transfers to them the command signals and/or ON and OFF signals, and data signals. The printer control unit 109 is electrically connected, via circuits for driving motors and actuators (not shown), to the ADF/document reader unit 113, stencil-perforating/feeding unit activating mechanism 114, stencil take-up unit activating mechanism 115, sheet-feeding unit activating mechanism 116, printing mechanism 117, and print conveyor activating mechanism 118. The printer control unit 109 transfers the command signals and/or ON and OFF signals, and data signals to and from the foregoing activating mechanisms and drivers, so that it controls activation, de-activation, and timing of the overall functions of the stencil printer 1.

The data signals and the ON and OFF signals are sent to the printer control unit 109 from the sheet sensor 40 as well as the keys on the control panel 80, i.e. the START key 82, numeric keys 81, MODE SELECT key 83, STOP key 89, MODE CLEAR key 94, and CLEAR key 95. In response to the mode signal from the MODE SELECT key 83, the printer control unit 109 not only provides a signal for lighting each LED lamp 84 to a lamp driving circuit (not shown) but also transfers the mode signal to the sorter control unit 119.

In the printer control unit 109, the ROM 111 stores not only programs for activating and de-activating the activating mechanisms and units in FIG. 3 and their timing programs but also programs for enabling the printer control unit 109 to execute the foregoing functions, and necessary data. The RAM 112 of the printer control unit 109 temporarily stores computed results of the printer CPU 110, and stores the data signals, and stores ON and OFF signals of the control panel keys as occasion demands.

The sorter control unit 119 is electrically connected not only to the printer control unit 109 but also to the print passage sensor 60, print sensors 39, and bin-unit-home position sensor 37 in order to transfer the ON and OFF signals and the data signals therebetween. Further, the sorter control unit 119 is in electrical connection with motors for the intermediate delivery unit activating mechanism 123, bin unit activating mechanism 124, jogger 70, and stapling unit 75. In response to signals from the foregoing sensors, the sorter control unit 119 provides command signals to the foregoing members. The sorter control unit 119 controls, activates and de-activates the on-line sorter 30 whose operation is essential to the stencil printer 1. In other words, in response to the signals related to the foregoing six functions, the sorter control unit 119 controls the rotation of the motor for the intermediate delivery unit 31, and the motor for the lift of the bin-unit 34, such that the prints 21 can be delivered to the bins 33 by appropriately moving the bin unit 34.

In the sorter control unit 119, the ROM 121 stores the programs for activating and de-activating the on-line sorter 30 in order to execute the respective operation modes, programs related to operation commands and operation timing for the on-line sorter 30 in response to the printing operation of the stencil printer 1 (such as sheet feeding, printing, and discharging of prints), and data necessary for the printing operation. The RAM 122 temporarily stores computed results of the sorter CPU 120, and stores data signals, and ON and OFF signals on a random basis.

The print passage sensor 60 detects each print passing through the print inlet 35, and signals it to the sorter control unit 119. In response to the signal, the sorter control unit 119 provides a command signal to the motor (in the stand 36) for moving the bin unit 34. This command signal is used to activate the foregoing motor such that the lead cam is rotated once each time one print 21 passes through the print inlet 35. Thus, the bins 33 are moved up (or down) step by step at a predetermined speed.

The bin-unit-home-position sensor 37 detects whether or not the bin unit 34 is at its home position, and provides a position signal to the sorter control unit 119.

(Operation of the First Embodiment)

The following describe a series of operations of the stencil printer 1 and the on-line sorter 30.

It is assumed that 50 sets of prints are produced from a 5-leaf original G (i.e. five originals G). First of all, the operator places the originals G on the original support 11*a* of the ADF 11 of the stencil printer 1, and presses the MODE SELECT key 83 once on the control panel 80 so as to select the sort mode. The LED lamp 84*a* is lit, indicating the selection of the sort mode. Generally, the stencil printer 1 and the sorter 30 are in the non-sort mode, as described previously. The number of prints to be produced is entered as "50" using numeric keys 81, followed by depression of the ENTER key 85. Then, the guidance screen 91 indicates a message "SORT MODE IS SELECTED. NO. OF PRINTS IS 50.". Hereinafter, the depression of the ENTER key 85 is referred to in order to simplify the description.

In response to the sort mode signal and the number-of-prints signal (i.e. "sort mode" +"N=50"), the printer control unit 109 determines that the sort mode cannot be simply executed since there are only 20 bins 33, and that the first and second sorting steps should be sequentially performed according to the special sorting schedule of the invention. In this case, the number L of originals G is 5 (i.e. $L \leqq M$), so that "5" is not specifically entered by pressing numeric keys 81 and the ENTER key 82. Thus, the printer control unit 109 determines that $L \leqq M$, selects the program related to the first and second sorting steps, and computes data for Grouping and sorting prints. In other words, the number N of prints per original G is larger than M (i.e. N (=50)>M (=20)), so that the printer control unit 109 selects the programs for the first and second sorting steps.

In the first sorting step, the prints 21 are delivered to the respective bins 33 in the grouped state. In the second sorting step, the operator removes the prints 21 from the bins 33, and relocates them to the sheet tray 20 which is empty. Then, the sort mode is executed so as to collect and arrange the prints 21 in proper sequence. The second sorting step is repeated a necessary number of times under the control of the printer control unit 109 in accordance with the program for controlling the activating mechanisms and units in FIG. 3.

The printing operation is performed in the following manner. First of all, the ADF/document reader unit 113 is activated. The ADF 11 delivers the first original G to the document reader 2, where the original G is optically read by the scanner. Optical data of the original G are converted into an electrical image signal by an image sensor 13 composed of a CCD (charge-coupled device). In the stencil perforating unit 3, the stencil-perforating/feeding unit activating mechanism 114 is activated such that the thermal head 15 thermally and selectively perforates a fresh stencil 14 on the basis of the image signal.

Concurrently with the foregoing operation, DC motors for the stencil take-up unit activating mechanism 115 and the printing mechanism 117 are activated. Specifically, the print drum 16 having a used stencil 14A thereon is rotated counterclockwise by the DC motor. The stencil peeler 18 peels the used stencil 14A off from the print drum 16, and discharges it into the used stencil box 19. Thereafter, the print drum 16 rotates further, and stops at a stencil receiving position. The clamp 16A is opened by its opening member (not shown). In this state, the print drum 16 is free from the used stencil 14A, i.e. it is ready for receiving the perforated new stencil 14. The removal of the used stencil 14 is thus completed.

The perforated new stencil 14 is conveyed to the clamp 16A, has its leading edge caught by the clamp 16A, and is then wrapped round the print drum 16. The platen roller (shown without a reference numeral) is stopped when a stepping motor (not shown) of the platen roller rotates a fixed number of steps and when the perforated stencil 14 is fed predetermined amount. The stencil 14 is cut at its trailing edge by the cutter (shown without a reference numeral). The stencil perforating process is completed when the perforated stencil 14 is completely wrapped round the print drum 16.

In the first sorting step, the printing of sheets and delivery of printed sheets are performed in the following manner.

The printing process is started, so that the sheet-feeding unit activating mechanism 116, printing unit activating mechanism 117, and print conveyor activating mechanism 118 are activated as required.

First of all, each top sheet 21 is paid out and separated from the sheet tray 20 by the sheet feed rollers 22, and is conveyed to the printing unit 4 in a sheet feeding direction Xa. The sheet 21 is timed by the register rollers 25 so as to be conveyed in synchronization with the rotation of the print drum 16, and is fed into a space between the print drum 16 and the press roller 23. The sheet 21 is pressed by the ascending press roller 23 against the print drum 16 rotating clockwise (shown by an arrow in FIG. 1), and is printed. Specifically, the original image (of the first original G) on the perforated stencil 14 is transferred onto the sheet 21 using ink applied to the inner surface of the print drum 16. The ink is supplied by the ink supply 17. The printed sheet 21 (now called "the print 21") is separated from the print drum 16 by the print separating member (not shown) of the print discharging unit 6, and is conveyed in a print feeding direction Xb, i.e. to the intermediate delivery unit 31. In synchronization with or slightly earlier than the operation of the print conveyor 24, the motor for the intermediate delivery unit 31 is activated. Thus, the print 21 moved onto an endless belt (shown without a reference numeral in FIG. 1) of the intermediate delivery unit 31 is conveyed to the print inlet 35 of the on-line sorter 30. The print 21 remains attracted onto the endless belt by a suction member (not shown). In this state, the bin unit 34 remains raised to its highest position, i.e. the bottom bin 33A confronts the print inlet 35.

The first print which is produced immediately after the perforated new stencil 14 is wrapped round the print drum 16, may be used as a trial print. The trial print is used for checking whether the stencil 14 is correctly wrapped and other matters, and is preferably delivered to the non-sort tray 32. The printer control unit 109 is programmed such that the first or trial print is not counted as one of 50 prints of the first original G. Judging the trial print to be acceptable, the operator presses the START key 82. Details of the trial print will be omitted here so as to simplify the description.

Ten prints of the first original G are continuously distributed to No. 1 bin 33A in FIG. 4. The tenth print of the first original G is detected by the print passage sensor 60 at the print inlet 35. In response to the signal from the print passage sensor 60, the sorter control unit 119 controls the motor of the bin unit 34 such that the lead cam makes one rotation. Thus, the bins 33 are lowered by one step.

Thereafter, twenty prints are distributed to No. 2 bin 33B. Passage of the twentieth print is detected by the print passage sensor 60 at the printed sheet inlet 35. In response to the signal from the print passage sensor 60, the sorter control unit 119 controls the motor of the bin unit 34 such the lead cam rotates once. The second rotation of the lead cam lowers the bins 33 one step. The upward or downward movement of the bin unit 34 will be not repeatedly described hereinafter in order to simplify the description, unless otherwise necessary.

Thereafter, the remaining 20 prints will be continuously delivered to No. 4 bin 33D. Thus, 50 prints of the first original G are obtained in this manner.

The second original G is then conveyed by the ADF 11. The stencil 14 used for the first original G is removed from the print drum 16 by the stencil peeler 18. An image of the second original G is read by the document reader 2. At the same time, a fresh stencil 14 is perforated on the basis of image data from the document reader 2. The perforated stencil 14 is wrapped around the print drum 16.

The image perforated on the stencil 14 is printed on sheets 21. Similarly to the prints of the first original G, ten prints of the second original G are delivered to No. 1 bin 33A, i.e. on the ten prints of the first original G. Twenty prints of the second original G are delivered to No. 2 bin 33B, i.e. on the twenty prints of the first original G. Then, the remaining 20 prints of the second original G are continuously delivered to No. 4 bin 33D, i.e. on top of the existing twenty prints of the first original G. Thus, 50 prints of the second original G are produced.

Fifty prints of the third original G will be produced, and delivered similarly to the prints of the first and second originals G. Specifically, ten prints are stacked in No. 1 bin 33A, twenty prints are in No. 2 bin 33B, and the remaining twenty prints are in No. 4 bin 33D.

Further, fifty prints of the fourth original G will be produced, and delivered as follows: ten prints are delivered to and stacked in No. 1 bin 33A; twenty prints are delivered to No. 3 bin 33C; and the remaining 20 prints are delivered to No. 5 bin 33E.

Finally, fifty prints of the final original G will be produced and delivered similarly to the prints of the fourth original G. Specifically, ten prints are delivered to No. 1 bin 33A, twenty prints are to each of No. 3 and No. 5 bins 33C and 33E, respectively.

In the foregoing state, the prints are grouped as shown in FIG. 4, but are not collected and arranged in proper sequence in accordance with the originals G.

Referring to FIG. 4, No. 1 bin 33A accommodates 50 prints, i.e. ten prints each of the first to fifth originals G. No. 2 bins 33B and No. 4 bins 33D accommodate 60 prints, respectively, i.e. 20 prints each of the first to third originals G. Further, Nos. 3 and 5 bins 33C and 33E accommodate 40 prints, respectively, i.e. 20 prints each of the fourth and fifth originals G. In other words, 50 prints each of the five originals G, i.e. a total of 250 prints, are stacked in the bins 33A to 33E. Thus, the first sorting step is completed.

At the end of the first sorting step, the guidance screen 91 of the liquid crystal display 90 issues a message "PRINTING IS FINISHED. REMOVE SHEETS FROM SHEET TRAY.". The operator then removes the sheets 21 from the sheet tray 20. The guidance screen 91 issues a second message "RELOCATE PRINTS FROM NO. 1 BIN TO SHEET TRAY WITHOUT CHANGING ORIENTATION.". The operator moves the prints in accordance with the message. The guidance screen 91 offers a message "RELOCATE PRINTS FROM NO. 2 BIN TO SHEET TRAY WITHOUT CHANGING ORIENTATION." Thus, the operator relocates all the prints from Nos. 1 to 5 bins 33A to 33E to the sheet tray 20.

The printer control unit 109 checks whether or not the operator correctly observes the foregoing instructions, on the basis of signals from the print sensors 39 of the bins 33, and from the sheet sensor 40 of the sheet tray 20. The printer control unit 109 controls the operation of not only the stencil printer 1 but also the activating mechanisms and unit of the on-line sorter 30 such that the sorting operation proceeds to a next step only when the instructions are correctly observed.

For example, it is assumed that the operator erroneously relocates the twenty prints of the fourth original G and the twenty prints of the fifth original G from No. 5 bin 33E to the sheet tray 20. In such a case, first of all, the print sensor 39 of No. 5 bin 33E provides a signal indicative of an empty state of No. 5 bin 33E to the printer control unit 109. The printer control unit 109 immediately determines that the instructions have not been correctly observed, and provides an alarm signal to the liquid crystal display 90. Not only does the guidance screen 91 offer a warning message but also the sub-guidance screen 92 blinks a portion related to the incorrect operation. At the same time, the second sorting step is suspended. In addition, a buzzer may be sounded so as to doubly alert the operator.

Figure 5:
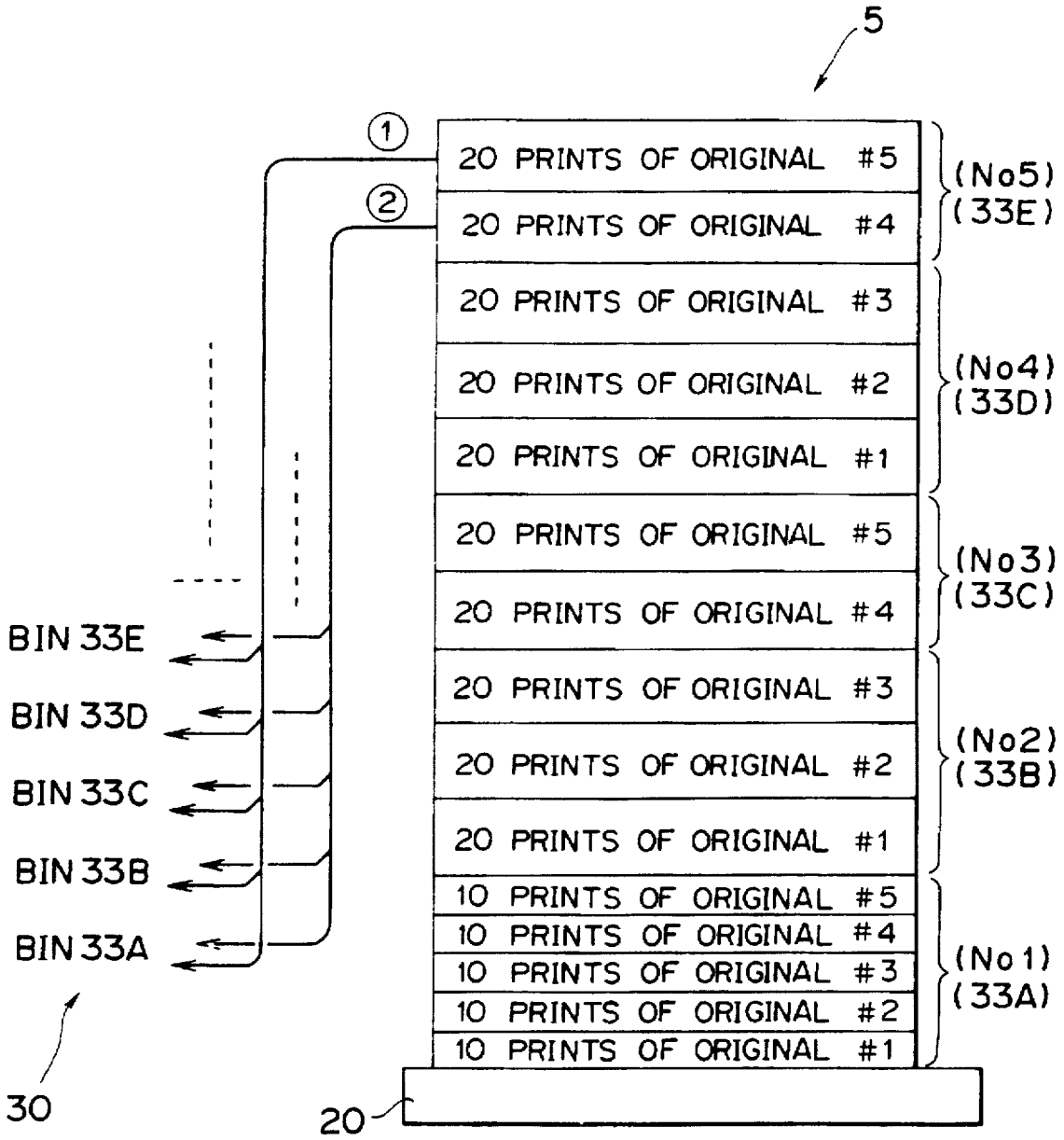
FIG. 5 shows a state of printed sheets which are replaced on a sheet tray for a second sorting step.

The second sorting step will be started for all of the 250 prints which are placed on the sheet tray 20 as shown in FIG. 5. The guidance screen 91 gives a message "PRESS START KEY TO EXECUTE FIRST GATHERING.". Here, the term "gathering" denotes the collection and arranging in proper sequence the prints forming a set. The operator presses the START key 82 as instructed. First of all, the stencil printer 1 performs the following. Referring to FIG. 1, the print drum 16, in the printing unit activating mechanism 117 of the printing unit 4, is rotated in the direction opposite to the arrow, i.e. counterclockwise. Similarly, the stencil take-up unit activating mechanism 115 of the stencil take-up unit 7 is activated. The used stencil 14 of the fifth original G is peeled off from the print drum 16, and is discharged into the used stencil box 19. Thereafter, the stencil perforating/feeding unit activating mechanism 114 of the stencil perforating unit 3 is activated, which enables the special control scheme of the invention to be executed. In other words, a fresh stencil 14 is paid out from the stencil roll, and is wrapped around the print drum 16 without being perforated by the thermal head 15. In this state, the prints 21 (shown in FIG. 5) are conveyed to the on-line sorter 30 one by one from the sheet tray 20 by the operation of the printing unit 4. However, no printing is performed since the stencil 14 is not perforated.

Thereafter, the prints 21 are distributed to the bins 33 such that they are collected and arranged in proper sequence therein. First of all, the prints of the fifth original G are separated by the feed rollers 22 one by one, and are conveyed toward the print conveyor 24 in the sheet feeding direction Xa, similarly to the first sorting step. Needless to say, no printing is performed on the prints 21 as described previously. The prints 21 are further carried to the intermediate delivery unit 31, which delivers them to the bins 33 of the on-line sorter 30. In this state, the bin unit 34 is raised highest, with the No. 1 bin 33A confronting with the print inlet 35.

The first print of the fifth original G is delivered to No. 1 bin 33A, the second print thereof is delivered to No. 2 bin 33B, the third print thereof is delivered to No. 3 bin 33C, . . . . . and the twentieth print thereof is delivered to No. 20 bin 33T while the bins 33 are moving downward step by step. Then, the twenty prints of the fourth original G are continuously delivered one by one to the bins 33A to 33T which are moved downward step by step.

Figure 6:
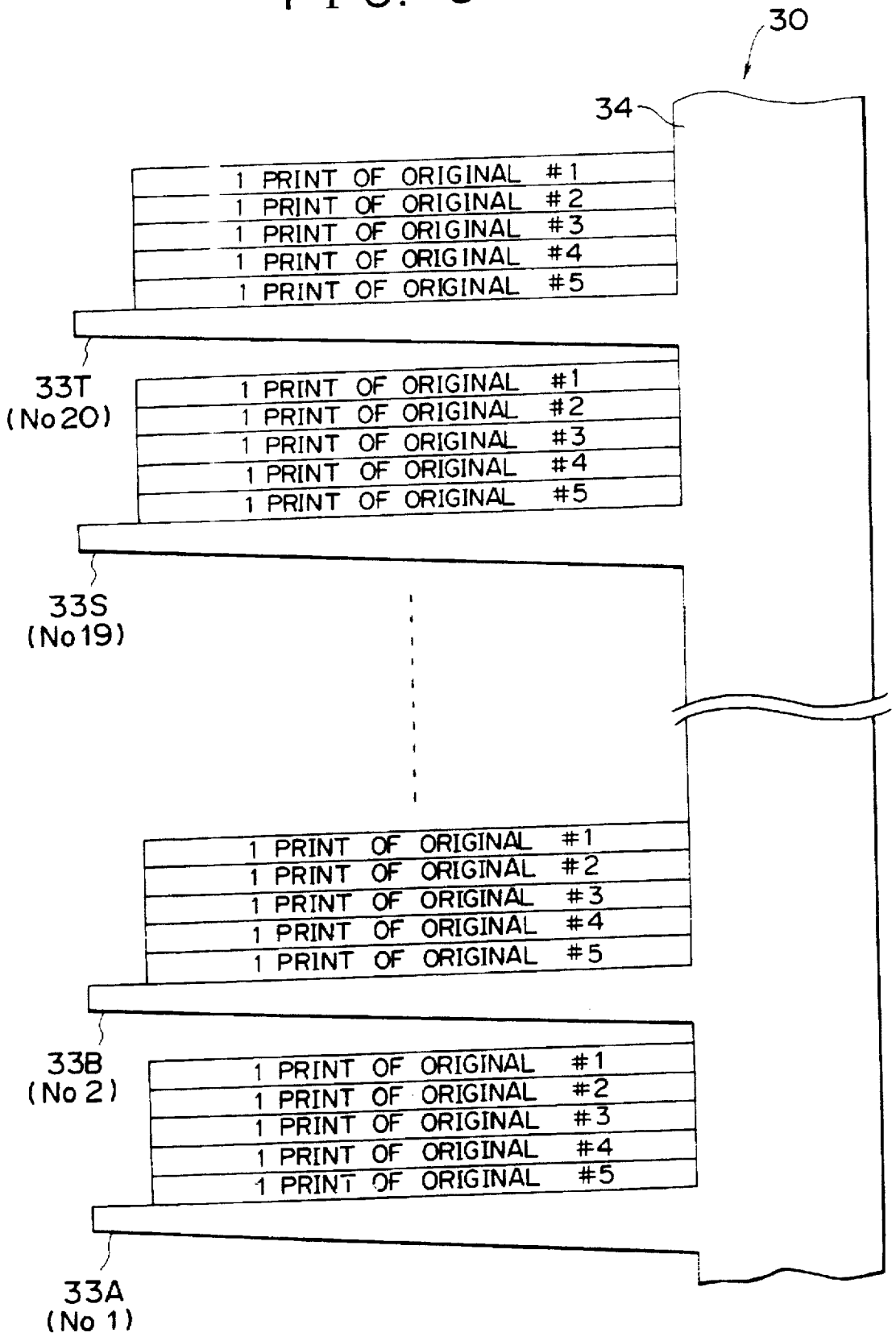
FIG. 6 shows a state in which, during the second sorting step, the printed sheets are collected and arranged in proper sequence in bins of the on-line sorter.

The twenty prints of the third original G are delivered one by one to the 20 bins as with the prints of the fourth document G. The twenty prints of each of the second and first originals G are delivered to the 20 bins 33 in a similar manner. A total of 100 prints of the five originals G are collected and arranged in proper sequence in the 20 bins 33, i.e. each bin 33 accommodates one set of 5 prints as shown in FIG. 6. In this state, the sheet feeding operation is temporarily interrupted. In FIG. 6, the prints are shown in an exaggerated form so as to enhance understanding.

The guidance screen 91 indicates a message "FIRST GATHERING IS FINISHED. REMOVE ALL PRINTS FROM BINS.". In response to the message, the operator takes all the prints from the bins 33. Then, the guidance screen 91 gives a message "PRESS START KEY TO PERFORM SECOND GATHERING.". The operator presses the START key 82 as instructed. The top prints on the sheet tray 20, i.e. the prints of the fifth original G, will be feed from the sheet tray 20 one by one, pass through the printing unit 4 without being printed, and are delivered to the bins 33 via the print conveyor 24 and the intermediate delivery unit 31 in a manner similar to the first gathering. The twenty prints of the fifth original G are delivered to Nos. 1 to 20 bins 33A to 33T. Thereafter, the twenty prints of each of the fourth to first originals G are distributed similarly to the prints of the fifth original G. A total of 100 prints of the first to fifth originals G are collected and arranged in proper sequence in the twenty bins 33, as shown in FIG. 6. Each bin 33 accommodates one set of five prints corresponding to the 5-leaf original document G. In this state, the stencil printer 1 has its operation temporarily stopped.

The guidance screen 91 then issues a message "SECOND GATHERING IS FINISHED. REMOVE ALL PRINTS FROM BINS.". The operator takes all the prints as instructed. Thereafter, the guidance screen 91 provides a message "PRESS START KEY TO PERFORM THIRD GATHERING.". The START key 82 is pressed in accordance with the message. The 50 prints of the first to fifth originals G, i.e. ten prints of each of the five originals G, are delivered to ten bins 33 via the printing unit 4, print discharging unit 6 and so on. The fifty prints are equally collected and arranged in proper sequence on the ten bins 33.

The first embodiment is effective in producing prints using an additional non-perforated stencil and some operator's assistance even when the number of sets of prints to be produced is larger than the number (i.e. 20) of bins 33 of the on-line sorter 30. The guidance screen 91 and sub-guidance screen 92 enable the operator to perform the sorting operation without difficulty.

Figure 7:
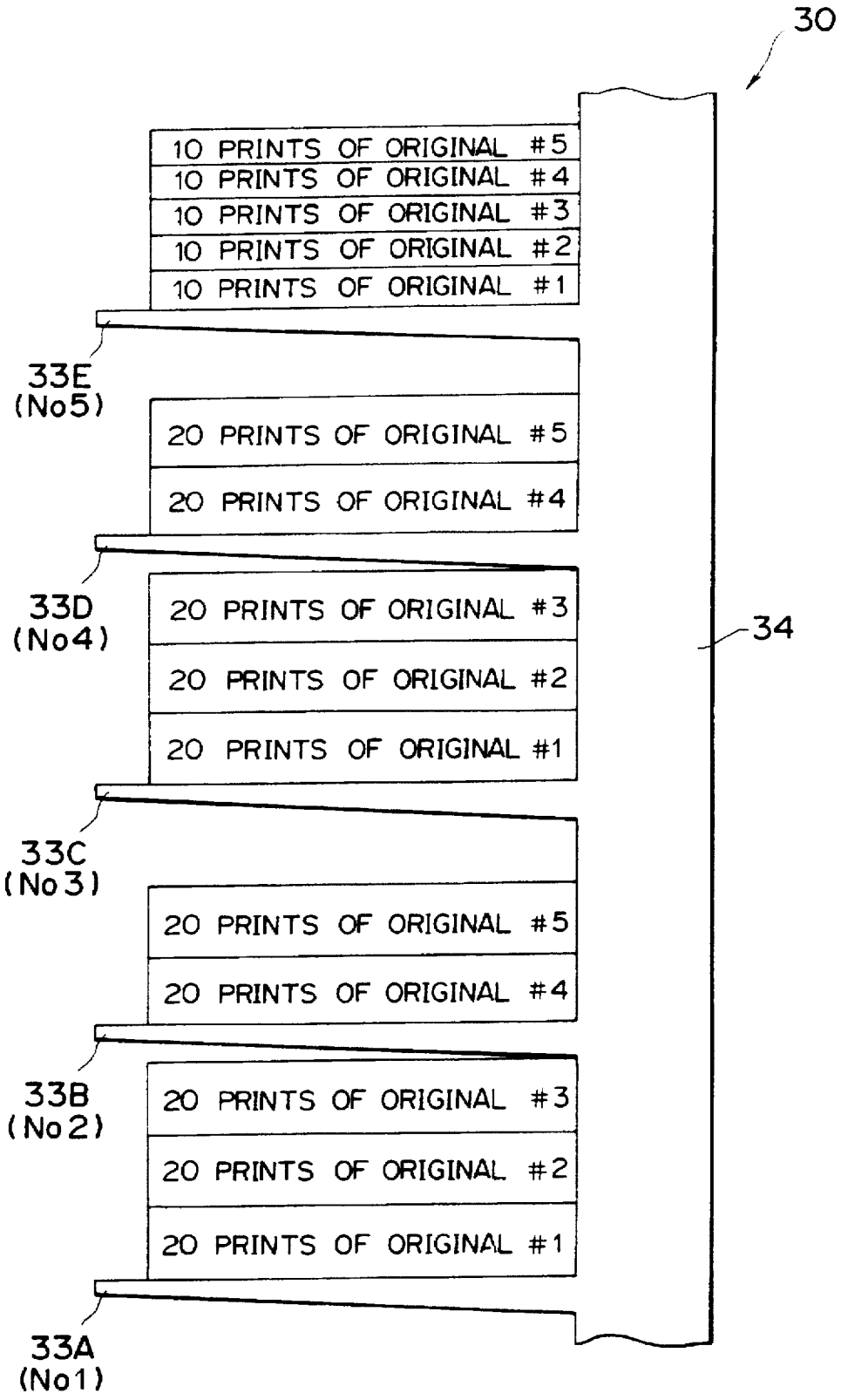
FIG. 7 shows a state in which printed sheets are grouped in a manner different from that shown in FIG. 4.

In this first embodiment, the prints are sorted as shown in FIG. 4 in the first sorting step, by way of example. Alternatively, the prints may be grouped as shown in FIG. 7. In this example, the 50 prints (delivered to No. 1 bin 33A in the example of FIG. 4) are delivered to No. 5 bin 33E. The remaining prints are grouped as in the example of FIG. 4, and are delivered to bins 33 which are shifted one step downward from those of FIG. 4. Needless to say, the prints which are grouped as shown in FIG. 7 can be easily collected and arranged in proper order in the second sorting step without any problem. Thus, this is not described here.

The originals G are fed and read from the first page onward in the first embodiment. If a document reader is designed so as to read the originals G in the order opposite to that in the first embodiment, the sorting steps can be easily modified so as to comply with a specification of a printer, based on the invention.

In this embodiment, when the final print of the fifth original G is delivered to No. 20 bin 33T (i.e. the bin unit 34 is at the home position), the bin unit 34 is raised. Then, the first print of the fourth original G is delivered to No. 1 bin 33A, and the succeeding prints are delivered to the bins 33 while the bin unit 34 is moved downward. In other words, the prints are delivered one by one to all the bins 33 only during the downward movement of the bin unit 34. Alternatively, it is possible to deliver the prints to the bins 33 during both downward and upward movements of the bin unit 34. In other words, after the final print of the fifth original G is delivered to No. 20 bin 33T, the first and succeeding prints of the fourth original G are delivered to No. 20 bin 33T down to No. 1 bin 33A while the bin unit 34 is moved upward. This method is advantageous in that the prints can be more efficiently delivered without useless movement of the bin unit 34.

(Embodiment 2)

The invention will be described with reference to a second embodiment shown in FIG. 8 and flowcharts in FIGS. 9 to 12. The flowcharts are depicted so as to assist the understanding of the outline of the control operations of this embodiment. The control operations are executed in accordance with determinations which are made on the basis of the programs stored in the ROM 111 of the printer CPU 110 and the data stored in the RAM 112.

Figure 9:
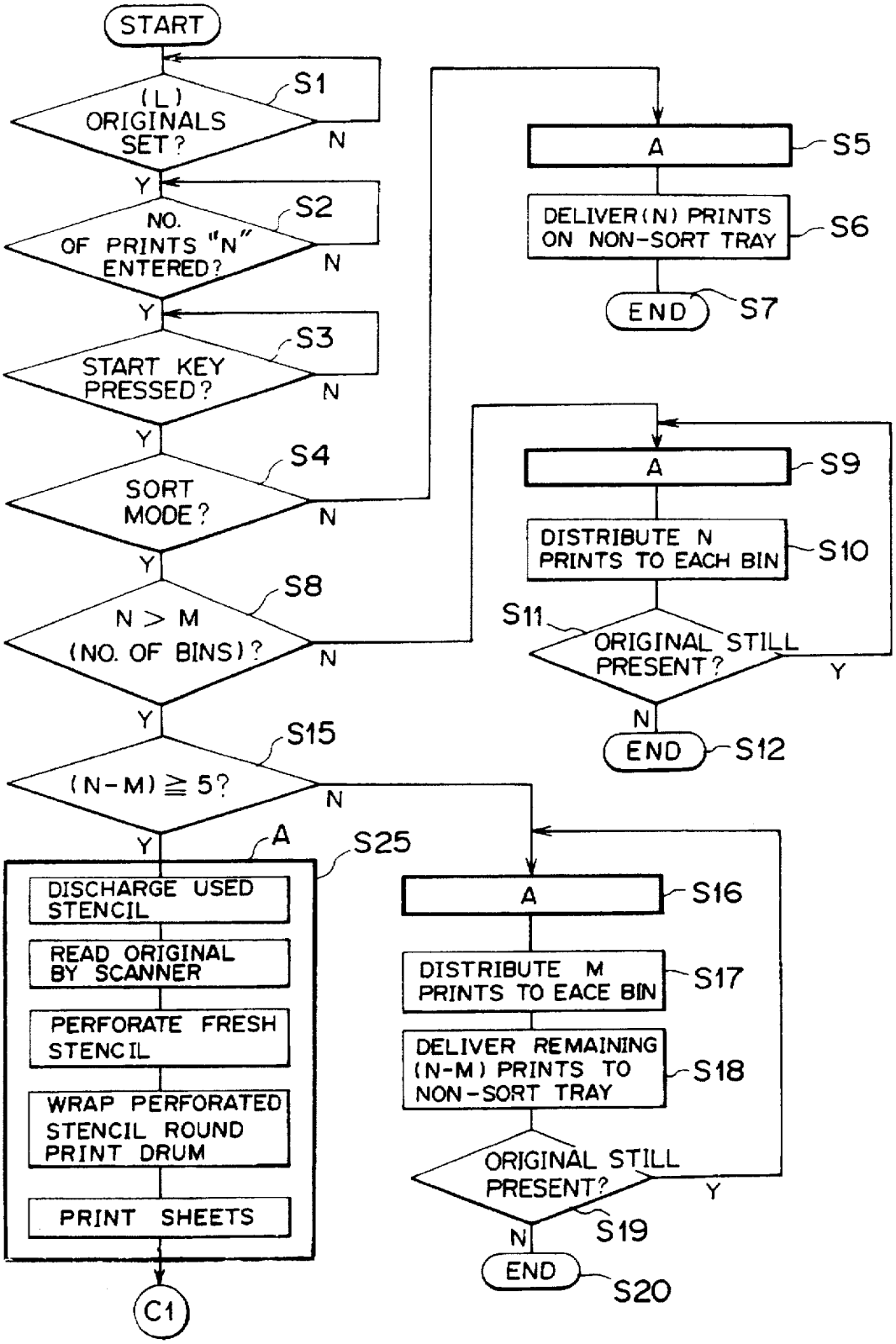
FIG. 9 is a flowchart of a control operation in the second embodiment.
Figure 10:
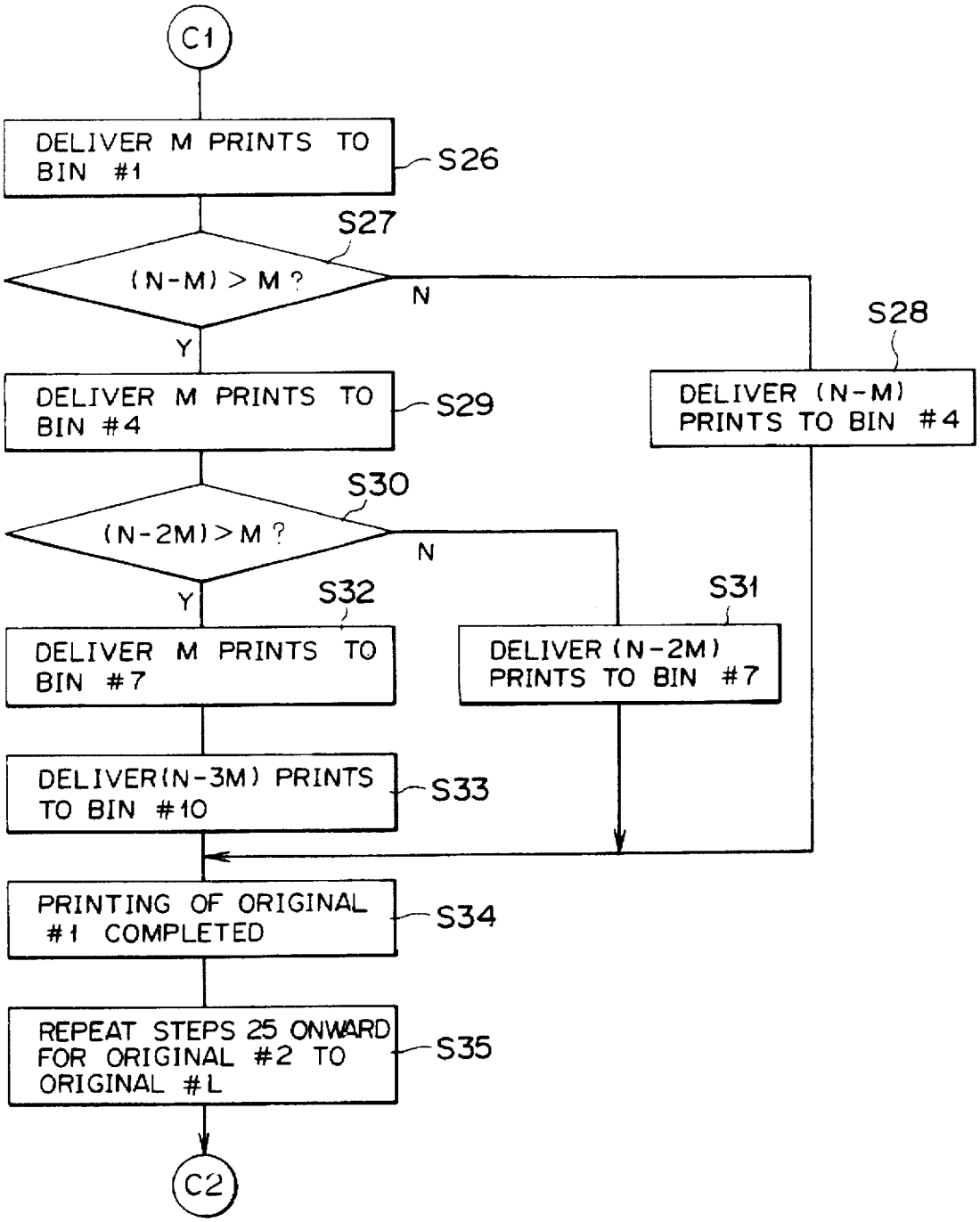
FIG. 10 is a continuation of the flowchart in FIG. 9.
Figure 11:
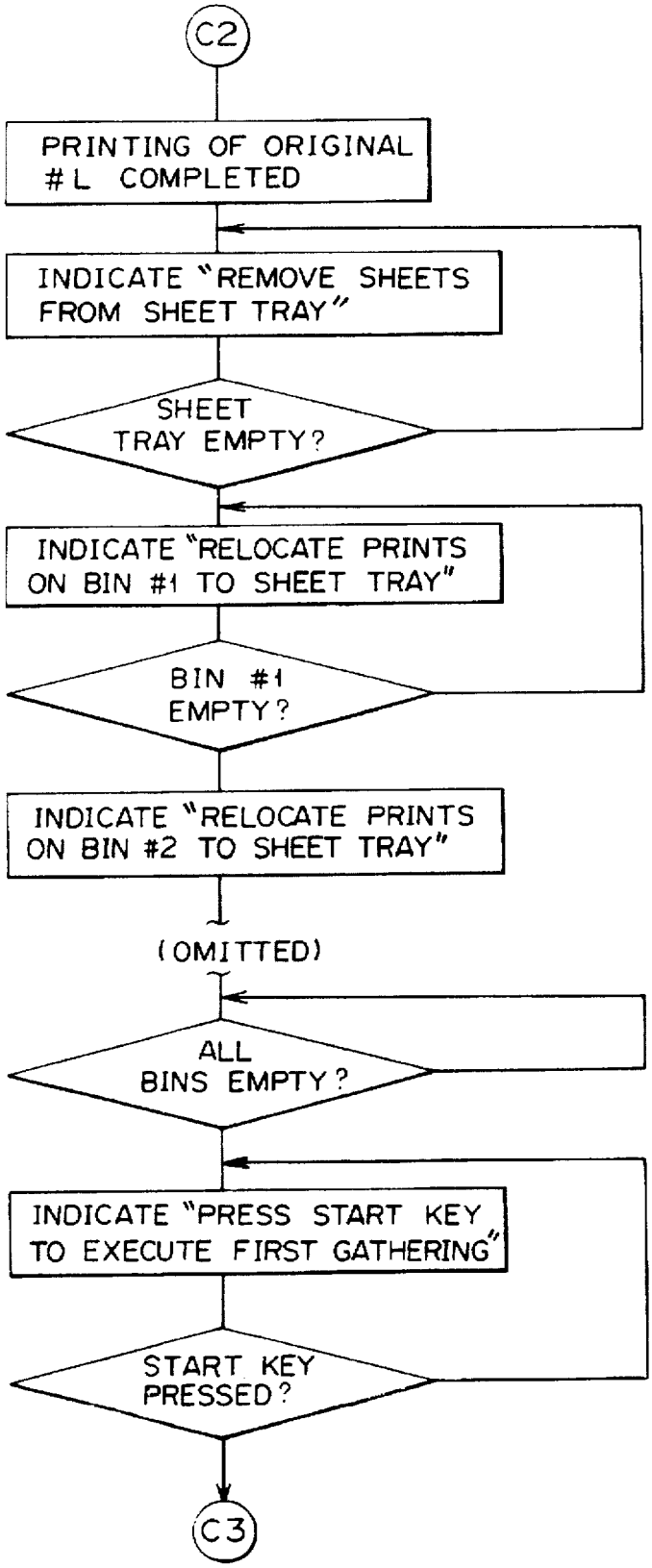
FIG. 11 is a continuation of the flowchart in FIG. 10.

Referring to FIG. 9, L originals G are set on the ADF 11 of the stencil printer 1, and "N" is entered as the number of prints produced, using the numeric keys 81 and so on. When the START key 82 is pressed but the MODE SELECT key 83 is not pressed (step S4), the printer control unit 109 determines the selection of the non-sort mode. In this mode, all the prints are delivered to the non-sort tray 32 (steps S1 to S7).

However, when the sort mode is selected in step $4, the printer control unit 109 determines that N prints of the L-leaf original G should be collected and arranged in proper sequence. The on-line sorter 30 is assumed to have M bins. If N≦M in step 8, procedures in steps 9 to 12 will be executed without any problem. In other words, N prints of each original G are delivered one by one to the respective bins 33. This is repeated for all of the L originals G. Thus, each bin 33 finally accommodates L prints of the L-leaf original G which are arranged in proper sequence.

In step S15, if N is slightly larger than M (e.g. M=20 and N=24), M prints of each original G will be distributed one by one to the 20 bins 33, and the remaining prints will be stacked on the non-sort tray 32. The foregoing process is repeated for the L originals G. Each bin 33 accommodates L prints which are collected and arranged in proper sequence while the non-sort tray 32 accommodates (N-M)×L prints which are not collected and arranged in proper sequence (steps S16 to S20). This is identical to the first method referred to in the description related to the prior art. In this case, it does not take a lot of time as a whole, even if the non-sorted prints are manually collected and arranged in proper sequence.

In step S15, if N is much larger than M, the manual collection and arrangement of the prints becomes troublesome and time-consuming. In such a case, the special sorting scheme of the invention is preferable.

The basic operations A in step S25, in an enclosed area, are executed. First of all, prior to the printing operation, a used stencil 14A is removed from the print drum 16 by the stencil peeler 18 of the stencil take-up unit 7. A first original G is fed to the document reader 2, where it is read by the scanner. A fresh stencil 14 is paid out and is perforated by the thermal head 15 in accordance with image data of the first original G. The perforated stencil 14 is wrapped round the print drum 16. Sheets 21 are fed by the feed rollers 22 of the sheet feeding unit 5, and are printed by the printing unit 4. The printed sheets are separated and conveyed by the print discharging unit 6, and are delivered to the bins 33 of the on-line sorter 30 via the intermediate delivery unit 31 as described with reference to the first embodiment.

In step S26, M prints are continuously delivered to No. 1 bin 33A.

When (N-M)>M in step S27, M prints will be delivered to No. 4 bin 33D (step S29). Conversely, when (N-M)≦M, control advances to step S28, so that (N-M) prints will be delivered to No. 4 bin 33D.

When (N-2M)>M in step S30, control advances to step S32. Thereafter, M prints will be delivered to No. 7 bin 33G, and the remaining (N-3M) prints will be delivered to No. 10 bin 33J. Thus, the printing of the first original G is completed. Conversely, when (N-2M)≦M in step 30, control advances to step S31, (N-2M) prints will be delivered to No. 7 bin 33G. The printing of the first original G is completed.

Thereafter, control returns to the basic operation A in step S25 so as to produce prints of the second original G.

In step S26, M prints of the second original G are continuously delivered to No. 1 bin 33A, i.e. on the prints of the first original G.

When (N-M)>M in step S27 similarly to the prints of the first original G, M prints will be delivered to No. 4 33D (step S29). Conversely, when (N-M)≦M, control advances to step S28, so that (N-M) prints will be delivered to No. 4 bin 33D.

In step S30, when (N-2M)>M, control goes to step S32, so that M prints will be delivered to No. 7 bin 33G while the remaining (N-3M) prints will be delivered to No. 10 bin 33J, i.e. on top of the (N-3M) prints of the first original G. The printing of the second original G is completed at this point. Conversely, when (N-2M)≦M in step S30, control advances to step S31, (N-2M) prints of the second original G are delivered to No. 7 bin 33G. The printing of the second original G is thus completed.

If the maximum capacity P of each bin 33 is less than 3M (i.e. P<3M), the first M prints of the third original G will be delivered to No. 2 bin 33B while the second M prints of the third original G will be delivered to No. 5 bin 33E. The remaining (N-2M) prints will be delivered to No. 7 bin 33G.

Conversely, if P≧(3M), the first M prints of the third original G will be delivered to No. 1 bin 33A, and the second M prints thereof will be delivered to No. 4 bin 33D. The remaining (N-2M) prints thereof will be delivered to No. 7 bin 33G. In any case, whenever "M" multiplied by an integer exceeds the maximum capacity P of each bin 33, M prints will be always delivered to a next bin 33.

Figure 8:
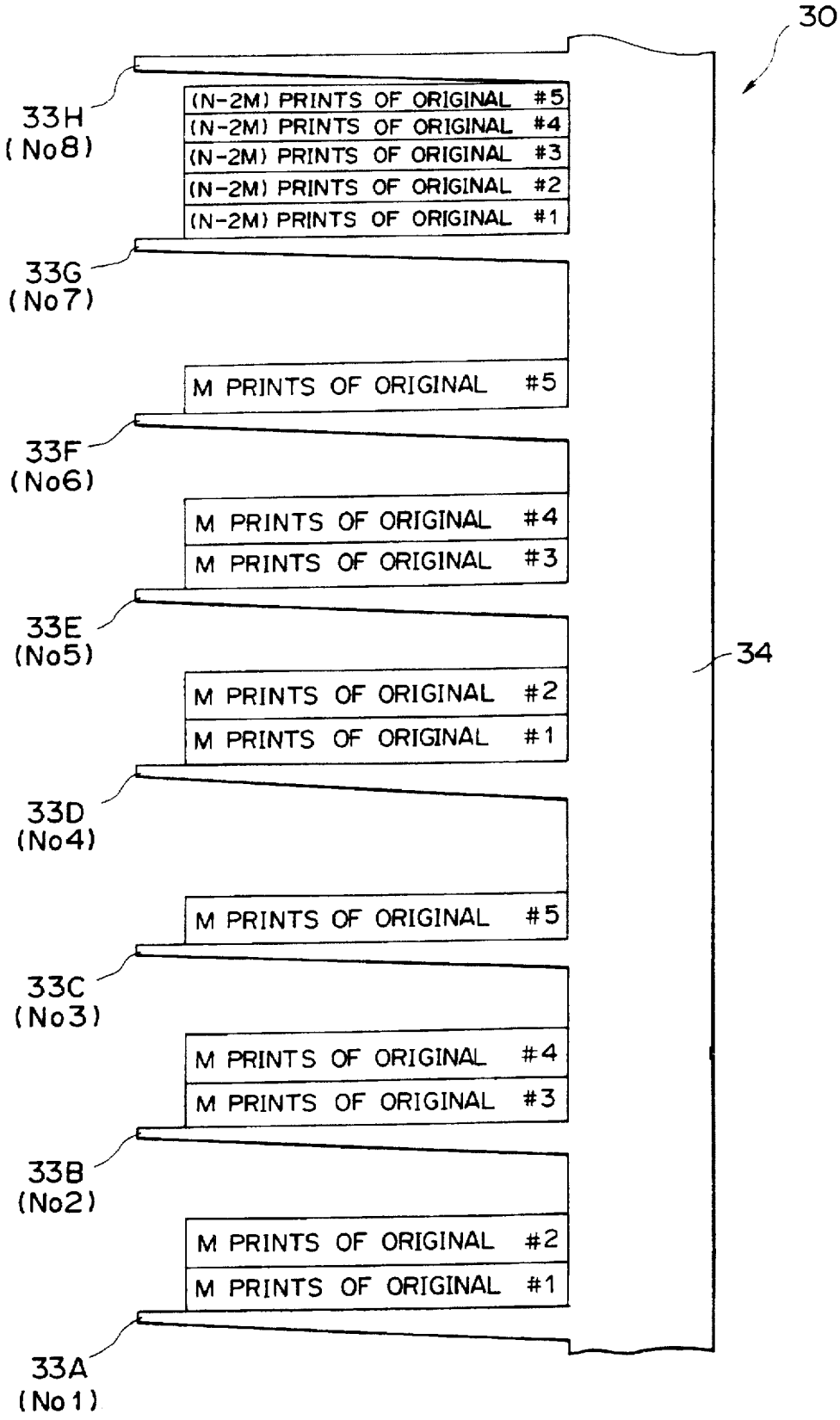
FIG. 8 shows a state in which printed sheets are grouped by the on-line sorter according to the first sorting step in a second embodiment of the invention.
Figure 12:
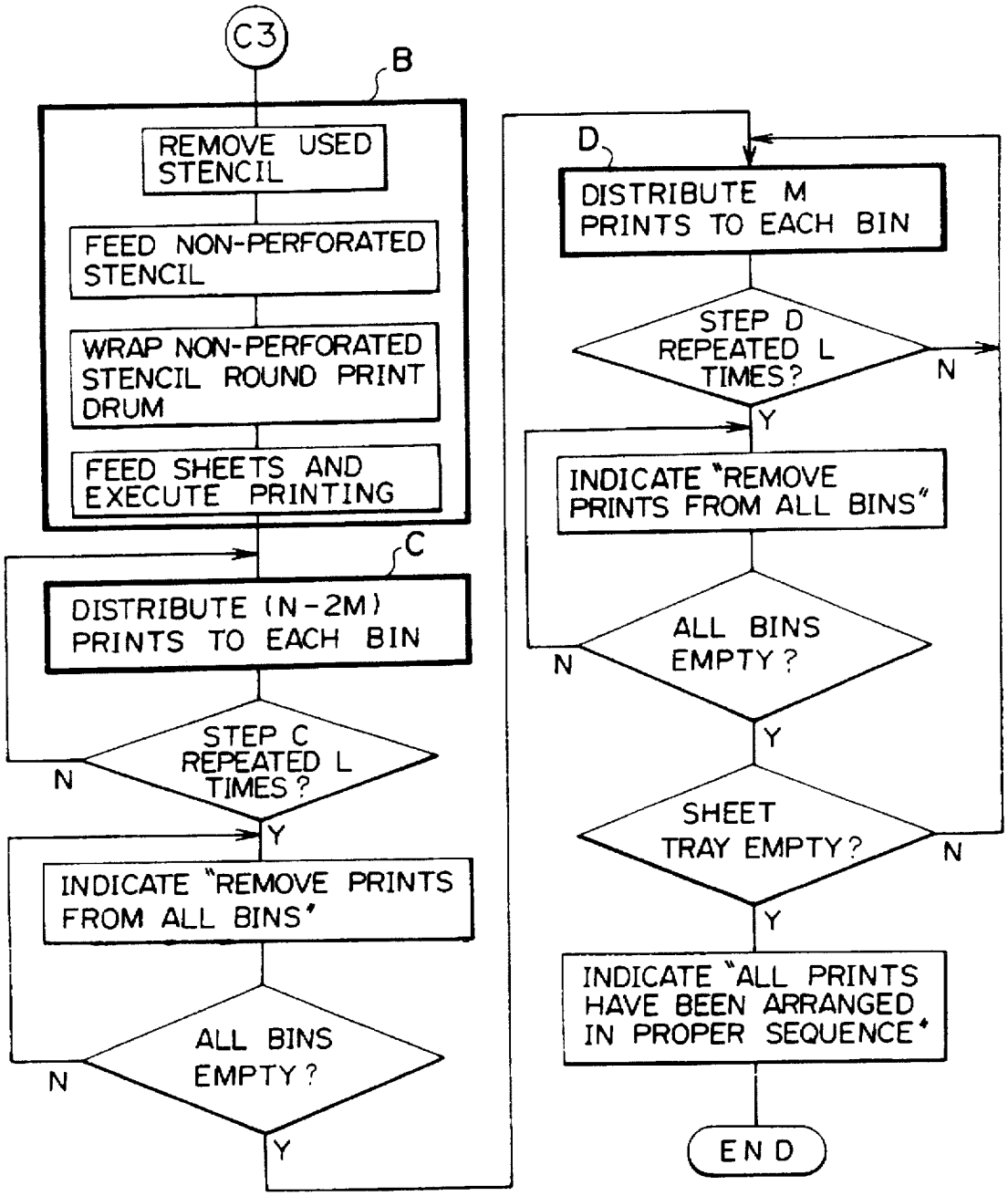
FIG. 12 is a continuation of the flowchart in FIG. 11.

FIG. 8 shows how prints of the L (=5) originals G are delivered to and received in the bins 33. In this example, (3M)>P. Each bin 33 accommodates 2M prints (e.g. the maximum capacity P per bin is 50 prints, and M (=20) bins are available). When (L×N) prints of the L originals G are delivered to the bins 33, the guidance screen 91 of the liquid crystal display 90 will offer the following guidance. This will be described with reference to the flowcharts in FIGS. 11 and 12. In FIG. 12, symbol B denotes the basic printing operations of the printing unit 4 in the second sorting step. The gathering operations C and D are controlled in a similar manner as those mentioned previously, and will be not repeated here in order to simplify the description.

In the invention, it is preferable that the maximum capacity P per bin 33 is an integer time of M (M=the total number of bins 33). In order to control the operations of the mechanisms and units in FIG. 3, the printer control unit 109 determines whether or not the sorting steps of the invention are applicable based on the input data concerning the number L of originals, the number N of prints, the total number M of bins, and the maximum capacity P per bin. Further, the printer control unit 109 determines the number of prints of the first original to be delivered to No. 1 bin on the basis of M and P, destinations of the remaining prints of the first original, and so on on the basis of M.

According to the invention, the originals G are read with their image sides facing down. In this case, it is preferable that the guidance screen 91 gives a message such as "CONFIRM THAT ORIGINALS ARE FACING DOWN." in order to alert the operator.

(Embodiment 3)

Figure 13:
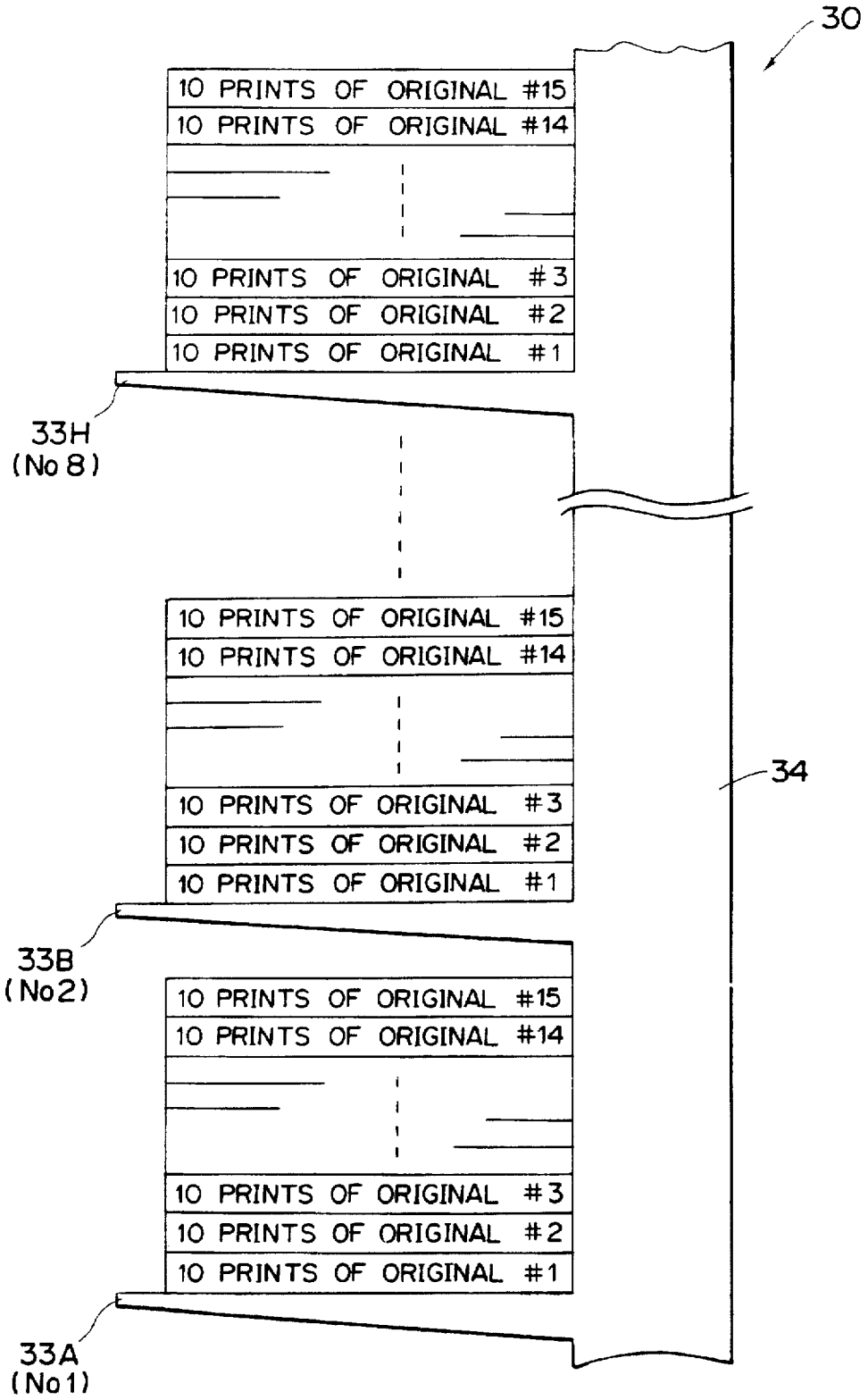
FIG. 13 shows a state in which printed sheets are grouped by the on-line sorter according to the first sorting step in a third embodiment of the invention.
Figure 14:
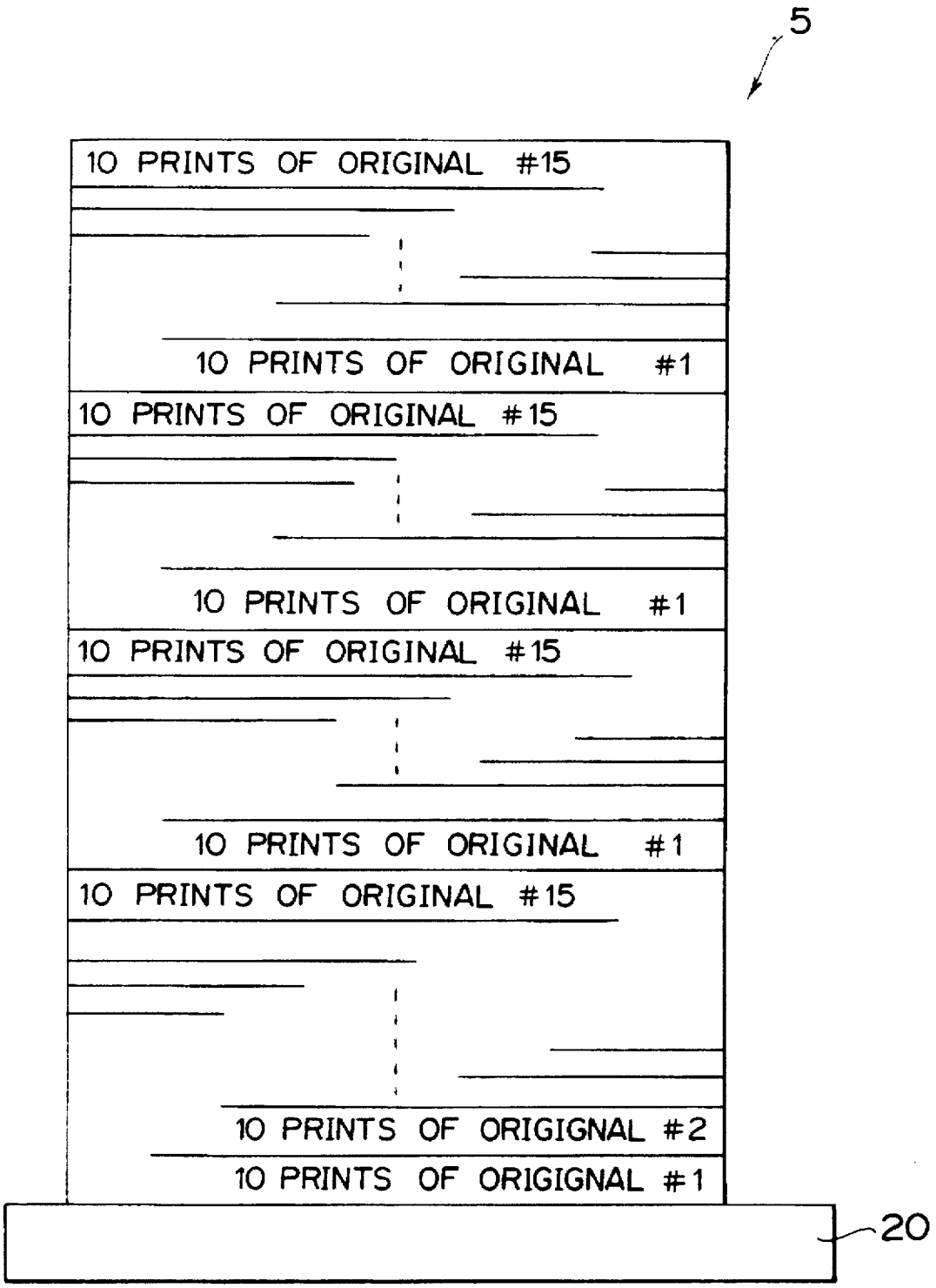
FIG. 14 shows a state in which the printed sheets are stacked on the sheet tray in the third embodiment.
Figure 15:
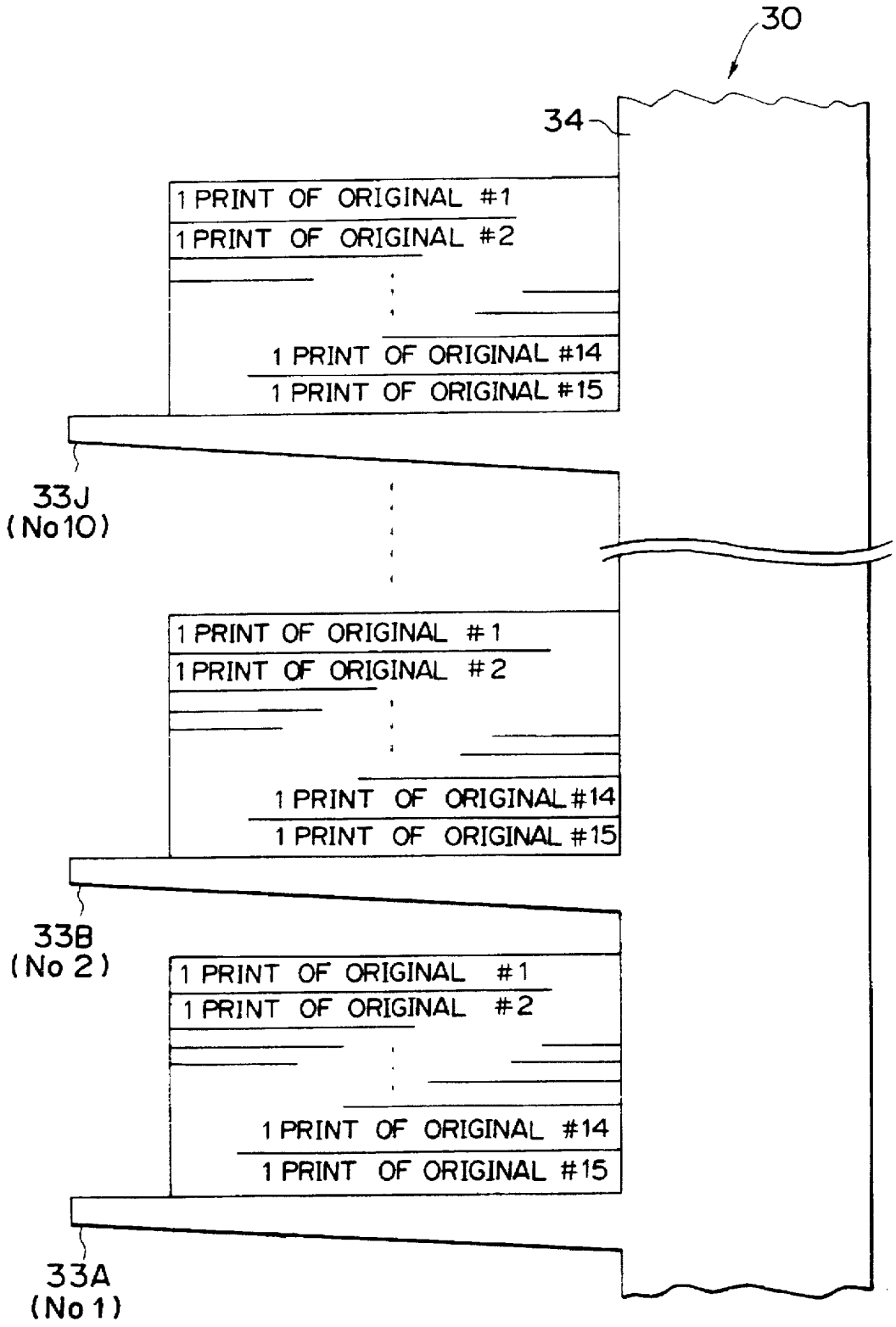
FIG. 15 shows a state in which the printed sheets are collected and arranged in proper sequence by the on-line sorter by the second sorting step in the third embodiment.

The invention will be described with a third embodiments shown in FIGS. 13 to 15, in which the on-line sorter 30 is assumed to include M bins 33 each having a large maximum capacity P (e.g. P=200). M is small, e.g. 10.

It is assumed that 80 prints are produced from an original documents G having fifteen leaves (called as the "15 originals G", and "first to fifteenth originals G" hereinafter). In summary, L=15, M=10, N=80, and P=200.

First of all, the operator sets the 15 originals G on the ADF 11 of the stencil printer 1. Numeric keys 81 and the ENTER key 85 are pressed so as to register "15" as the number of originals G. The number of prints "80" is set by the numeric keys 81 and so on. The MODE SELECT key 83 is pressed so as to select the sort mode, followed by the START key 82. The printer control unit 109 then calls the data denoting M=10 and P=200 from the ROM 111, and checks whether (L×M) is equal to or smaller than P. In this case, (L×M)=150 (i.e. L=15, and M=10), which is less than P (=200). The number N of prints divided by M is 8 (i.e. 80/10=8), so that eight bins are used in the first sorting step.

The first sorting step will be executed. The first original G is read, a stencil 14 is perforated in accordance with image data of the read original G, and sheets are printed. Eighty prints of the first original G are equally distributed to No. 1 bin 33A to No. 8 bin 33H, i.e. each bin 33 accommodates M (=10) prints. Next, 80 prints of the second original G are produced and are equally delivered to No. 1 to No. 8 bins 33A–33H in the similar manner. Eighty prints each of the third to fifteenth originals G will be printed and delivered to No. 1 to No. 8 bins 33 similarly to those of the first and second originals G. At this point in time, No. 1 bin 33A accommodates ten prints each of the 15 originals G (i.e. a total of 150 prints), as shown in FIG. 13. The same holds true for each of No. 2 to No. 8 bins 33B to 33H.

In this state, the guidance screen 91 indicates "RELOCATE PRINTS FROM NOS. 1–8 BINS IN SHEET TRAY WITHOUT CHANGING ORIENTATION.". Since it is troublesome to sort 1,200 prints in one sorting procedure, the operator relocates the 600 prints in No. 1 to No. 4 bins to the sheet tray 20 as shown in FIG. 14, and places the remaining 600 prints in No. 5 to No. 8 bins as they are on a table or the like.

The second sorting step will be executed so as to collect and arrange the prints in proper sequence. The Guidance screen 91 indicates "PRESS START KEY TO PERFORM FIRST GATHERING." When the START key 82 is pressed, the stencil printer 1 executes its printing operation as described above.

In the stencil printer 1, a previously used stencil 14A of the fifteenth original G is removed from the print drum 16, and a non-perforated fresh stencil 14 is wrapped thereon. The printing operation is carried out using the non-perforated stencil 14, i.e. the top prints having the image of the fifteenth original G are separated and fed one by one to the printing unit 4. The prints are then conveyed through the stencil printer 1, and are delivered one by one to No. 1 to No. 10 bins (33A–33J) as shown in FIG. 15 while the bin unit 34 is moving down step by step. In this state, the bin unit 34 is temporarily stopped. Thus, each of ten bins 33 accommodates one print of the fifteenth original G.

Both the stencil printer 1 and the on-line sorter 30 then resume their operations. The ten prints of the fourteenth original G are delivered one by one to No. 10 bin 33J, No. 9 bin 33I, . . . No. 1 bin 33A while the bin unit 34 is moving up step by step. Then, the bin unit 34 temporarily stops moving. In this state, each bin 33 accommodates one print of the fourteenth original G. Thereafter, ten prints each of the thirteenth original G, ten prints each of twelfth, . . . ten prints each of the first original G will be delivered to the ten bins 33A to 33J in the similar manner. After this, the stencil printer 1 and the on-line sorter 30 stop operating.

Next, the guidance screen 91 indicates "FIRST GATHERING IS FINISHED. REMOVE ALL PRINTS FROM BINS." In this state, each bin 33 accommodates a total of 15 prints which are collected and arranged in proper sequence according to the first to fifteenth originals G.

When the on-line sorter 30 includes the jogger 70 and the stapling unit 75 which are shown only in FIG. 3, each set of 15 prints may be straightened by the jogger 70, and may be stapled by the stapling unit 75. Needless to say, the prints which are produced according to the first and second embodiments may be also stapled as in this embodiment.

The guidance screen 91 then indicates "PRESS START KEY TO PERFORM SECOND GATHERING." The operator presses the START key 82 as instructed, so that the operations identical to the foregoing operations are repeated again. Specifically, 150 prints are distributed to No. 1 bin 33A up to No. 10 bin 33J, so that each bin 33 accommodates 15 prints which are collected and arranged in proper sequence.

The second sorting step is repeated four times in order to deliver a total of 600 prints which are relocated to the sheet tray 20. Thus, the prints are collected and arranged in proper sequence on the respective bins 33. Therefore, the second sorting step is further repeated four times such that the prints stacked on the table are delivered to the respective bins 33, and are collected and arranged in proper sequence. Thus, 80 sets of the 15-leaf prints are collected and arranged in proper sequence. For this purpose, fifteen pieces of stencils 14 are used for the fifteen originals G, and one additional piece of stencil 14 is used for the second sorting step. In other words, the on-line sorter 30 having only ten bins can be used to produce 80 sets of prints from the 15-leaf original G.

In the foregoing embodiments, the on-line sorter 30 includes the movable bins 33. Alternatively, the on-line sorter 30 may have stationary bins such those as disclosed in Japanese Utility Model Laid-Open Publication No. Hei 4-105057.

The stencil printer 1 used in the foregoing embodiments may be an intaglio printer. Further, the method and the control system of the invention may be applied to an electrophotographic copying machine, or may be used in combination with such a machine through some modifications.

The invention is effective in producing a very large number of prints, and collecting and arranging them in proper order even when the stencil printer is used in cooperation with a small and inexpensive on-line sorter with a reduced number of bins. The prints can be collected and arranged in proper sequence without wasting the stencil, and without requiring a large space for manual operation. The method of the invention can be executed simply by modifying the control units of the image forming apparatus and the sorter, and without the need of additional special expensive units.

The control system of the invention automatically determines a border between the sort mode plus the manual sorting and the sort mode including the first and second sorting steps. Thus, the operator is free from the problems of such selection, and is simply required to set the number of prints to be produced and to select a desired operation mode. The prints can be collected and arranged in proper sequence effectively and efficiently in a short time period.

When producing a large number of prints, the control system of the invention determines the optimum form of gathering on the basis of relationships between the number L of originals, the total number M of bins of the sorter, the maximum capacity P per bin, and the number N of prints to be produced.

What is claimed is:

1. A method of sorting prints which carry original images printed by an image forming apparatus and are delivered to bins of a sorter used in combination with the image forming apparatus, the method comprising:

(a) a first sorting step in which prints are delivered to bins of the sorter in a grouped state; and (b) a second sorting step in which the prints grouped in the process (a) are manually removed from the bins, are relocated to a sheet tray of the image forming apparatus, and are conveyed from the sheet tray through the image forming apparatus and are delivered to the bins where the prints are collected and arranged in proper sequence, and wherein images of the original document are printed on sheets in the first sorting step while no image is printed on the prints in the second sorting step.

2. The method according to claim 1, wherein: when the number N of prints to be produced from an original document having a plurality of leaves is equal to or less than a total number M of bins of the sorter (i.e. $N \leqq M$), a sort mode is executed in order to deliver prints of the original document to the bins where they are collected and arranged in proper sequence in accordance with the original document; and when N is more than M (N>M), the first and second sorting steps are sequentially executed in order to deliver the prints to the bins where they are collected and arranged in proper sequence.

3. The method according to claim 1, wherein the image forming apparatus is a stencil printer which uses a stencil wrapped around a print drum and prints the image on sheets which are pressed against the stencil by a pressing member, and in the first sorting step, the printer prints sheets using a perforated stencil, but in the second sorting step, the printer performs the printing operation using a non-perforated stencil wrapped around the print drum.

4. A control system for an image forming apparatus which produces prints by forming original images on sheets fed from a sheet tray and includes a sorter for delivering the prints to bins thereof, the control system comprising:

(a) a sort mode setting member for establishing a sort mode for delivering prints of each leaf of the original document to bins where the prints are collected and arranged in proper sequence in accordance with the original document, and issuing a signal indicative of the sort mode;

(b) a member for setting the number of prints to be produced from the original document having a plurality of leaves, and issuing a signal indicative of the number of prints; and (c) control units for controlling activating mechanisms of the image forming apparatus and the sorter in the following manners: when the number N of prints to be produced from an original document having a plurality of leaves is equal to or smaller than the number M of bins of the sorter (i.e. $N \leqq M$), the control units executes the sort mode in order to deliver prints of the original document to N bins where the prints are collected and arranged in proper sequence in accordance with the original document; and when N is more than M (N>M), the control units execute the sort mode by means of a first sorting step in which prints are delivered to bins of the sorter in a grouped state, and by means of a second sorting step in which the prints grouped in the first sorting step are manually removed from the bins, are relocated to a sheet tray of the image forming apparatus, are conveyed from the sheet tray through the image forming apparatus, and are delivered to the bins where the prints are collected and arranged in proper sequence in accordance with the original document, and wherein the control units control the activating mechanisms so as to enable the image forming apparatus to print sheets in the first sorting step, and to disable the image forming apparatus to print sheets in the second sorting step.

5. The control system according to claim 4, wherein: the sorter includes a non-sort tray; the control units are capable of setting a natural number $\alpha$ having values of a predetermined range; the control units control the activating mechanisms of the image forming apparatus and the sorter in order to sequentially perform the first and second sorting steps when the number N of prints produced per original document is equal to or larger than M (the number of bins) plus the natural number $\alpha$(i.e. $N \geqq (M+\alpha)$); and the control units control the activating mechanisms in order to perform the sort mode for M prints, and to deliver $\alpha$ prints to the non-sort tray when $N<(M+\alpha)$.

6. The control system according to claim 5, wherein the natural number $\alpha$ is determined depending upon whether or not it is preferable and convenient to manually collect and arrange the prints, in the non-sort tray, in proper sequence.

7. The control system according to claim 4, wherein when the original document has L leaves, each bin has a maximum capacity P, and the number N of prints to be produced per leaf of the original document is larger than a total number M of bins (i.e. N>M), the control units control the activating mechanisms so as to perform the first sorting step in which prints are grouped such that (L×M) prints are equally delivered to N/M bins (with the decimals rounded up), and the second sorting step in which the prints are equally delivered to all of the M bins by repeating the sort mode N/M times (with the decimals carried up) such that each bin accommodates L prints.

8. The control system according to claim 7, wherein the control units control the activating mechanisms such that the first sorting step is repeated for every M leaves of the original document, and each time the sort mode is repeated L times to deliver every M prints to each bin in the second sorting step, the control units temporarily interrupt the operations of the image forming apparatus and the sorter, thereby enabling the operator to relocate the prints to the sheet tray several times.

9. The control system according to claim 4, further comprising a display for offering instructions indicative of operations to be performed by the operator in the first and second sorting steps.

10. The control system according to claim 9, wherein the display is a liquid crystal display, and provides the instructions literally and/or visually in accordance with an operation sequence.

11. The control system according to claim 9 or 10, wherein the display is disposed on a control panel of the image forming apparatus or the sorter.

12. The control system according to claim 9, further comprising a sheet sensor for detecting sheets on the sheet tray and print sensors for detecting prints on the respective bins, and wherein the control units check, on the basis of signals from the sheet sensor and the print sensors, whether or not the instructions on the display are correctly observed, and control the activating mechanisms such that printing and sorting operations are advanced to a subsequent process only when the instructions are correctly observed.

13. The control system according to claim 4, 9, or 12, wherein the image forming apparatus is a stencil printer which includes a print drum for wrapping a perforated stencil thereon and a press member, and prints via the perforated stencil sheets pushed by the press member, and the control units control the stencil printer so as to print the sheets in the first sorting step, and control the stencil printer to perform the printing operation using a non-perforated stencil in the second sorting step.

14. The control system according to claim 11, further comprising a sheet sensor for detecting sheets on the sheet tray and print sensors for detecting prints on the respective bins, and wherein the control units check, on the basis of signals from the sheet sensor and the print sensors, whether or not the instructions on the display are correctly observed, and control the activating mechanisms such that printing and sorting operations are advanced to a subsequent process only when the instructions are correctly observed.

15. The control system according to claim 14, wherein the image forming apparatus is a stencil printer which includes a print drum for wrapping a perforated stencil thereon and a press member, and prints via the perforated stencil sheets pushed by the press member, and the control units control the stencil printer so as to print the sheets in the first sorting step, and control the stencil printer to perform the printing operation using a non-perforated stencil in the second sorting step.

* * * * *

UNITED STATES PATENT AND TRADEMARK OFFICE

CERTIFICATE OF CORRECTION

PATENT NO. : 5,735,202

DATED : APRIL 7, 1998

INVENTOR(S) : SAKAKIBARA ET AL

It is certified that error appears in the above-identified patent and that said Letters Patent is hereby corrected as shown below:

Column 12, line 27, change "82" to --85--;

Column 12, line 66, change "14" to (second occurrence) to --14A--.

Column 16, line 16, change "feed" to --fed--.

Column 17, line 35, change "$4" to S4.

Column 18, line 64, change "and will be not" to --and will not be--.

Column 20, line 57, change "such those as" to --such as those--.

Signed and Sealed this

Twenty-second Day of December, 1998

Bruce Lehman

*Attest:*

BRUCE LEHMAN

*Attesting Officer*

*Commissioner of Patents and Trademarks*